US012004651B2

(12) United States Patent
Smith et al.

(10) Patent No.: US 12,004,651 B2
(45) Date of Patent: Jun. 11, 2024

(54) BED FOUNDATION ADJUSTMENT CONTROLS

(71) Applicant: Sleep Number Corporation, Minneapolis, MN (US)

(72) Inventors: David Smith, Minneapolis, MN (US); Antony Kirk, Minnetonka, MN (US)

(73) Assignee: Sleep Number Corporation, Minneapolis, MN (US)

( * ) Notice: Subject to any disclaimer, the term of this patent is extended or adjusted under 35 U.S.C. 154(b) by 0 days.

(21) Appl. No.: 17/547,782

(22) Filed: Dec. 10, 2021

(65) Prior Publication Data

US 2022/0192388 A1 Jun. 23, 2022

Related U.S. Application Data

(60) Provisional application No. 63/127,307, filed on Dec. 18, 2020.

(51) Int. Cl.
*A47C 19/04* (2006.01)
*A47C 31/00* (2006.01)

(52) U.S. Cl.
CPC ..... *A47C 19/045* (2013.01); *A47C 31/008* (2013.01)

(58) Field of Classification Search
CPC ... A47C 19/045; A47C 31/008; A47C 20/041; A47C 19/04; A47C 17/86
USPC ..... 5/618; 248/188.2
See application file for complete search history.

(56) References Cited

U.S. PATENT DOCUMENTS 815,481 A * 3/1906 Smith ..... A61G 7/02 5/604
1,686,002 A * 10/1928 Herzon ..... A47G 29/08 5/503.1
2,318,240 A * 5/1943 Mas ..... A61G 7/02 5/604
2,618,787 A * 11/1952 Dickson ..... A61G 7/02 5/604
2,702,909 A 3/1955 Atkins
(Continued)

FOREIGN PATENT DOCUMENTS

EP 2468142 3/2013
EP 2974705 1/2016

OTHER PUBLICATIONS

International Search Report and Written Opinion in International Appln. No. PCT/US2021/062851, dated May 16, 2022, 23 pages.
(Continued)

*Primary Examiner* — Justin C Mikowski
*Assistant Examiner* — Luke Hall
(74) *Attorney, Agent, or Firm* — Fish & Richardson P.C.

(57) ABSTRACT

A bed system can have an adjustable foundation and a user interface having at least one adjustment bar. The user interface can be communicatively coupled to an actuation system of the adjustable foundation such that raising a foot portion of the at least one adjustment bar can signal the actuation system to raise a foot section of the adjustable foundation, raising a head portion of the adjustment bar can signal the actuation system to raise a head section of the adjustable foundation, lowering the foot portion of the adjustment bar can signal the actuation system to lower the foot section of the adjustable foundation, and lowering the head portion of the adjustment bar can signal the actuation system to lower the head section of the adjustable foundation.

23 Claims, 21 Drawing Sheets

(56) References Cited

U.S. PATENT DOCUMENTS 2,932,831 A * 4/1960 Keathley, Sr. ..... A47C 21/00 5/604
3,089,150 A * 5/1963 Briggs ..... A47C 20/08 5/616
4,309,783 A * 1/1982 Cammack ..... A47C 31/008 5/660
4,499,618 A * 2/1985 Werner ..... A61G 7/002 192/48.8
4,644,597 A 2/1987 Walker
4,727,890 A * 3/1988 Vincent ..... A24F 15/18 248/311.2
4,766,628 A 8/1988 Walker
4,788,729 A 12/1988 Walker
4,809,180 A 2/1989 Saitoh
D300,194 S 3/1989 Walker
4,812,838 A 3/1989 Tashiro et al.
4,829,616 A * 5/1989 Walker ..... F04D 25/084 251/129.05
4,890,344 A 1/1990 Walker
4,897,890 A 2/1990 Walker
4,908,895 A 3/1990 Walker
D313,973 S 1/1991 Walker
4,991,244 A 2/1991 Walker
5,144,706 A 9/1992 Walker
5,170,522 A 12/1992 Walker
D368,475 S 4/1996 Scott
5,509,154 A 4/1996 Shafer et al.
5,564,140 A 10/1996 Shoenhair et al.
D377,876 S * 2/1997 Hatala ..... D6/513
5,605,235 A * 2/1997 Johnson ..... F16M 13/00 211/26.1
5,642,546 A 7/1997 Shoenhair
5,652,484 A 7/1997 Shafer et al.
5,715,548 A * 2/1998 Weismiller ..... A61G 7/052 5/624
5,765,246 A 3/1998 Shoenhair
5,758,972 A * 6/1998 Mack ..... A45C 3/00 5/503.1
5,791,001 A * 8/1998 Wang ..... A47C 27/001 5/942
5,903,941 A 5/1999 Shafer et al.
5,904,172 A * 5/1999 Gifft ..... A47C 27/082 137/271
6,037,723 A 3/2000 Shafer et al.
6,101,647 A * 8/2000 Stroud ..... A47C 20/041 5/915
6,108,844 A 8/2000 Kraft et al.
6,161,231 A 12/2000 Kraft et al.
6,163,507 A * 12/2000 Gholson ..... G04G 13/021 368/256
6,202,239 B1 3/2001 Ward et al.
6,397,419 B1 6/2002 Mechache
6,483,264 B1 11/2002 Shafer et al.
6,570,491 B1 * 5/2003 Bastholm ..... A47C 31/008 340/10.5
6,594,836 B1 * 7/2003 Everson ..... A47G 9/0246 5/497
6,686,711 B2 * 2/2004 Rose ..... G05D 16/2066 318/16
6,708,357 B2 3/2004 Gaboury et al.
6,763,541 B2 7/2004 Mahoney et al.
6,804,848 B1 * 10/2004 Rose ..... A47C 27/18 5/710
6,832,397 B2 12/2004 Gaboury et al.
D502,929 S 3/2005 Copeland et al.
6,883,191 B2 4/2005 Gaboury et al.
6,889,396 B2 5/2005 Weinman
6,894,234 B1 * 5/2005 Sottong ..... H01H 25/008 200/17 R
7,047,579 B2 5/2006 Piana et al.
7,284,791 B1 * 10/2007 Wright ..... A47C 7/624 211/26.1
7,389,554 B1 6/2008 Rose
7,865,988 B2 1/2011 Koughan et al.
7,959,229 B2 6/2011 Ishijima et al.
8,176,582 B2 5/2012 Beard et al.
8,336,369 B2 12/2012 Mahoney
D691,118 S 10/2013 Ingham et al.
D697,874 S 1/2014 Stusynski et al.
D698,338 S 1/2014 Ingham et al.
D701,536 S 3/2014 Shakal et al.
8,671,478 B2 3/2014 Rippe et al.
8,701,227 B2 4/2014 Rohr
8,769,747 B2 7/2014 Mahoney et al.
8,893,339 B2 11/2014 Fleury et al.
8,931,329 B2 1/2015 Mahoney et al.
8,966,689 B2 3/2015 McGuire et al.
8,973,183 B1 3/2015 Palashewski et al.
D728,254 S 5/2015 Blazar et al.
9,049,941 B2 6/2015 Clenet et al.
D737,250 S 8/2015 Ingham et al.
9,107,782 B2 8/2015 Ermalovich
9,204,742 B2 12/2015 Jensen et al.
9,220,351 B2 * 12/2015 Jensen ..... A47G 9/0246
9,314,118 B2 4/2016 Blazar et al.
9,516,952 B2 12/2016 Rohr et al.
9,578,941 B2 2/2017 MacLachlan et al.
9,730,524 B2 8/2017 Chen et al.
9,737,154 B2 8/2017 Mahoney et al.
D809,843 S 2/2018 Keeley et al.
D812,393 S 3/2018 Karschnik et al.
9,924,813 B1 3/2018 Basten et al.
10,143,312 B2 12/2018 Brosnan et al.
D840,732 S 2/2019 Peterson et al.
10,194,753 B2 2/2019 Fleury et al.
10,285,508 B2 5/2019 Rose et al.
D857,433 S 8/2019 Kiekhoefer et al.
10,531,745 B2 1/2020 Chen et al.
10,539,170 B2 1/2020 Peterson et al.
10,575,654 B2 3/2020 Shakal
10,677,232 B2 6/2020 Shakal et al.
10,729,253 B1 8/2020 Gaunt
10,736,434 B1 8/2020 Kinion
10,765,224 B2 9/2020 Chen et al.
10,813,470 B2 10/2020 Mahoney et al.
10,888,173 B2 1/2021 Shakal et al.
10,993,546 B2 5/2021 Shakal et al.
11,001,447 B2 5/2021 Shutes et al.
11,085,479 B2 8/2021 Griffith et al.
11,096,502 B2 8/2021 Rose et al.
D932,808 S 10/2021 Keeley
11,140,999 B2 10/2021 Peterson et al.
11,229,297 B2 1/2022 Gaunt
2004/0045086 A1 3/2004 Zheng
2006/0053555 A1 * 3/2006 Poulos ..... A61G 7/0514 5/618
2007/0157385 A1 * 7/2007 Lemire ..... A61G 7/0524 5/618
2007/0174965 A1 * 8/2007 Lemire ..... A61G 7/0528 5/630
2008/0134431 A1 6/2008 Piana
2014/0250597 A1 9/2014 Chen et al.
2015/0007393 A1 1/2015 Palashewski
2015/0182418 A1 * 7/2015 Zaiss ..... A61H 1/005 601/57
2016/0100697 A1 4/2016 Prochazka et al.
2016/0150890 A1 6/2016 Heeke et al.
2016/0262552 A1 9/2016 Scarleski
2018/0125259 A1 5/2018 Peterson et al.
2019/0047445 A1 * 2/2019 Kim ..... B60N 3/002
2019/0082855 A1 3/2019 Brosnan et al.
2020/0101877 A1 * 4/2020 Bonds ..... B60N 2/90
2020/0187667 A1 6/2020 Shakal
2020/0359805 A1 11/2020 Brosnan et al.
2020/0375369 A1 12/2020 Negus et al.
2020/0400135 A1 12/2020 Shakal et al.
2021/0145183 A1 5/2021 Negus et al.
2021/0145185 A1 5/2021 Negus et al.

(56) References Cited

OTHER PUBLICATIONS

U.S. Appl. No. 09/471,592, filed Dec. 23, 1999, Shafer.
U.S. Appl. No. 14/594,843, filed Jan. 12, 2015, Rose et al.
U.S. Appl. No. 17/006,388, filed Aug. 28, 2020, McGuire et al.
U.S. Appl. No. 17/078,558, filed Oct. 23, 2020, Hilden et al.
U.S. Appl. No. 17/145,645, filed Jan. 11, 2021, Shakal.
U.S. Appl. No. 17/224,936, filed Apr. 7, 2021, Shakal et al.
U.S. Appl. No. 17/374,369, filed Jul. 13, 2021, Griffith et al.
U.S. Appl. No. 17/408,661, filed Aug. 23, 2021, Rose et al.
U.S. Appl. No. 17/410,424, filed Aug. 24, 2021, Doffing et al.
U.S. Appl. No. 17/495,296, filed Oct. 6, 2021, Peterson et al.
U.S. Appl. No. 17/547,782, filed Dec. 10, 2021, Smith et al.
U.S. Appl. No. 17/582,253, filed Jan. 24, 2022, Gaunt.
U.S. Appl. No. 29/719,090, filed Dec. 31, 2019, Kirk et al.
U.S. Appl. No. 29/807,154, filed Sep. 9, 2021, Negus.
U.S. Appl. No. 29/821,785, filed Jan. 3, 2022, Negus et al.
Invitation to Pay Additional Fees in International Appln. No. PCT/US2021/062851, dated Mar. 25, 2022, 20 pages.

* cited by examiner

BED FOUNDATION ADJUSTMENT CONTROLS

CROSS-REFERENCE TO RELATED APPLICATIONS

This application claims the benefit of U.S. Provisional Application Ser. No. 63/127,307, filed Dec. 18, 2020. The disclosure of the prior application is considered part of (and is incorporated by reference in) the disclosure of this application.

TECHNICAL FIELD

This invention relates to beds, and more particularly, to adjustable beds having position controllers.

BACKGROUND

Adjustable beds can include a mattress positioned on top of an adjustable foundation. When the adjustable foundation is actuated, portions of the mattress can be raised and lowered, such as a head and foot of the mattress. People traditionally adjust the foundation using a handheld remote or via an application on a mobile device. Some buttons, remotes, or mobile applications can provide people with an option to adjust the foundation from a flat position to a preset position.

SUMMARY

Some embodiments of a bed system provided herein can include one or more of the features and functions disclosed herein. In particular, the bed system can include an adjustable foundation, a mattress positioned on the adjustable foundation, and an external bed position controller. The controller can be mounted on a side of the foundation and/or a deck of the foundation. The controller can be used instead of a remote or mobile application to selectively adjust portions of the adjustable foundation. The controller can be a user interface having one or more adjustment bars and/or buttons.

Embodiments described herein can include a bed system having an adjustable foundation. The adjustable foundation can include a head section, a foot section, an actuation system connected to the head section and the foot section, and a user interface having at least one adjustment bar. The user interface can be communicatively coupled to the actuation system such that raising a foot portion of the at least one adjustment bar signals the actuation system to raise the foot section of the adjustable foundation, raising a head portion of the at least one adjustment bar signals the actuation system to raise the head section of the adjustable foundation, lowering the foot portion of the at least one adjustment bar signals the actuation system to lower the foot section of the adjustable foundation, and lowering the head portion of the at least one adjustment bar signals the actuation system to lower the head section of the adjustable foundation.

In some implementations, the disclosed embodiments can have one or more of the following features. For example, the at least one adjustment bar can be a single rigid bar including both the head portion and the foot portion. As another example, the at least one adjustable bar can include first and second bars hingedly connected at central ends of the first and second bars. Raising the first bar can signal the actuation system to raise the foot section of the adjustable foundation, raising the second bar can signal the actuation system to raise the head section of the adjustable foundation, lowering the first bar can signal the actuation system to lower the foot section of the adjustable foundation, and lowering the second bar can signal the actuation system to lower the head section of the adjustable foundation.

In some implementations, raising the at least one adjustment bar can signal the actuation system to raise the foot section and the head section of the adjustable foundation at a same time and to a same height, and lowering the at least one adjustment bar can signal the actuation system to lower the foot section and the head section of the adjustable foundation at the same time and to the same height.

As another example, the user interface can also include at least one button. Pressing the at least one button can signal the actuation system to move at least one of the head section and the foot section of the adjustable foundation to a predetermined position, which can be at least one of a flat position and a favorite position.

Moreover, the at least one button can be connected to at least one switch. Pressing the at least one button can include actuating the at least one switch, which can signal the actuation system to move at least one of the head section and the foot section of the adjustable foundation to the predetermined position.

The at least one button can also include a first button and a second button such that pressing the first button can signal the actuation system to move the adjustable foundation to a flat position and pressing the second button can signal the actuation system to move the adjustable foundation to a favorite position.

In some implementations, double clicking the at least one button can cause the at least one adjustment bar to switch between a first mode for selectively adjusting the head section and the foot section of the adjustable foundation and a second mode for adjusting the head section and the foot section of the adjustable foundation at a same time.

As another example, the user interface can be connected to a side of the adjustable foundation. Sometimes, raising the head portion of the at least one adjustment bar can signal the actuation system to tilt the adjustable foundation to a predetermined angle. In some implementations, the actuation system can include a controller and one or more actuators that can raise and lower the head and foot sections of the adjustable foundation. In yet some implementations, the user interface can be sized based at least in part on a thickness of at least one of the adjustable foundation or a mattress positioned on the adjustable foundation. Additionally, the foot portion of the at least one adjustment bar can be positioned at an angle different than an angle of the head portion of the at least one adjustment bar such that the at least one adjustment bar can be tilted in at least one of a downward or an upward position.

In some implementations, the at least one adjustment bar can be positioned in a recessed region of the user interface, and the at least one button can be positioned beneath the at least one adjustment bar and in a recessed region of the user interface.

The user interface can also include a base that can be positioned between a top of the adjustable foundation and a bottom of a mattress positioned on the adjustable foundation such that the user interface can be flush with a side of the adjustable foundation and can extend up along a side of the mattress. The base of the user interface can attach to the top of the adjustable foundation using one or more fasteners. Moreover, the mattress can flatten down over the base of the user interface. The bottom of the mattress can also include a recess where the base of the user interface can be positioned. A material or foam of the mattress can be removed from the recess.

In some implementations, pressing the at least one button can signal the actuation system to raise the foot section and the head section of the adjustable foundation to a predetermined height at a same time.

Embodiments described herein can include a bed system having an adjustable foundation. The adjustable foundation can include a head section, a foot section, an actuation system connected to the head section and the foot section, and a user interface communicatively coupled to the actuation system. The user interface can include at least one adjustment bar and at least one button. Actuation of the at least one button can switch between a first bar mode and a second bar mode. In the first bar mode, actuation of a head end of the adjustment bar selectively can raise or lower the head section and actuation of a foot end of the adjustment bar can selectively raise or lower the foot section. In the second bar mode, actuation of the head end of the adjustment bar can tilt the head section and the foot section at substantially the same angle and actuation of the foot end of the adjustment bar can tilt the head section and the foot section at substantially the same angle.

Embodiments described herein can include a bed system having an adjustable foundation and a user interface having at least one adjustment bar. The adjustable foundation can have a head section, a foot section, and an actuation system connected to the head section and the foot section. The user interface can be communicatively coupled to the actuation system such that raising a foot portion of the at least one adjustment bar signals the actuation system to raise the foot section of the adjustable foundation, raising a head portion of the at least one adjustment bar signals the actuation system to raise the head section of the adjustable foundation, lowering the foot portion of the at least one adjustment bar signals the actuation system to lower the foot section of the adjustable foundation, and lowering the head portion of the at least one adjustment bar signals the actuation system to lower the head section of the adjustable foundation.

In some implementations, the disclosed embodiments can have one or more of the following features. A mattress can be positioned on the adjustable foundation, the mattress having a head section and a foot section. The at least one adjustment bar can be a single rigid bar including both the head portion and the foot portion. The at least one adjustable bar can include first and second bars hingedly connected at central ends of the first and second bars. Raising the first bar can signal the actuation system to raise the foot section of the adjustable foundation, raising the second bar can signal the actuation system to raise the head section of the adjustable foundation, lowering the first bar can signal the actuation system to lower the foot section of the adjustable foundation, and lowering the second bar can signal the actuation system to lower the head section of the adjustable foundation.

The user interface can also include a plurality of switches connected to the at least one adjustment bar, wherein raising and lowering the at least one adjustment bar can include actuating at least one of the plurality of switches. Raising the foot portion of the at least one adjustment bar can actuate a first switch of the plurality of switches and can signal the actuation system to raise the foot section of the adjustable foundation, raising the head portion of the at least one adjustment bar can actuate a second switch of the plurality of switches and can signal the actuation system to raise the head section of the adjustable foundation, lowering the foot portion of the at least one adjustment bar can actuate a third switch of the plurality of switches and can signal the actuation system to lower the foot section of the adjustable foundation, and lowering the head portion of the at least one adjustment bar can actuate a fourth switch of the plurality of switches and can signal the actuation system to lower the head section of the adjustable foundation. The first switch can be positioned above the third switch and the second switch can be positioned above the fourth switch.

The user interface can also include at least one button, wherein pressing the at least one button can signal the actuation system to move at least one of the head section or the foot section of the adjustable foundation to a predetermined position. The predetermined position can be at least one of a flat position or a favorite position. The at least one button can be connected to at least one switch, wherein pressing the at least one button can include actuating the at least one switch, which signals the actuation system to move at least one of the head section or the foot section of the adjustable foundation to the predetermined position. The at least one button can include a first button and a second button such that pressing the first button can signal the actuation system to move the adjustable foundation to a flat position and pressing the second button can signal the actuation system to move the adjustable foundation to a favorite position.

The user interface can be connected to a side of the adjustable foundation. The user interface can be moveable along a side of the adjustable foundation. The actuation system can include a controller and one or more actuators configured to raise and lower the head and foot sections of the adjustable foundation. The user interface can be sized based at least in part on a thickness of at least one of the mattress or the adjustable foundation. The foot portion of the at least one adjustment bar can be positioned at an angle different than an angle of the head portion of the at least one adjustment bar such that the at least one adjustment bar can be tilted in at least one of a downward or an upward position. The at least one adjustment bar can be positioned in a recessed region of the user interface. The at least one button can be positioned beneath the at least one adjustment bar and in a recessed region of the user interface. The at least one button can be communicatively coupled to one or more peripheral devices, wherein pressing the at least one button can include controlling the one or more peripheral devices.

The user interface can also include a base that can be positioned between a top of the adjustable foundation and a bottom of the mattress such that the user interface is flush with a side of the adjustable foundation and can extend up along a side of the mattress. The base of the user interface can attach to the top of the adjustable foundation using one or more fasteners. The mattress can flatten down over the base of the user interface. The bottom of the mattress can include a recess where the base of the user interface can be positioned, wherein a material or foam of the mattress can be removed from the recess. The foot section of the at least one adjustable bar can be proximate to the foot section of the adjustable foundation and the head section of the at least one adjustable bar can be proximate to the head section of the adjustable foundation. The at least one adjustable bar further can include a third bar hingedly connected at a central end of the third bar. The third bar can be positioned between the first and second bars, wherein raising the third bar can signal the actuation system to move the adjustable foundation to a favorite position and lowering the third bar can signal the actuation system to move the adjustable foundation to a flat position.

Embodiments described herein can also include a bed system having an adjustable foundation and a user interface. The adjustable foundation can include a head section, a foot section, and an actuation system connected to the head section and the foot section. The user interface can have first, second, third, and fourth buttons, wherein the user interface can be communicatively coupled to the actuation system such that pressing the first button can signal the actuation system to raise the foot section of the adjustable foundation, pressing the second button can signal the actuation system to raise the head section of the adjustable foundation, pressing the third button can signal the actuation system to lower the foot section of the adjustable foundation, and pressing the fourth button can signal the actuation system to lower the head section of the adjustable foundation.

In some implementations, the first and third buttons can be vertically aligned on the user interface and proximate to the foot section of the adjustable foundation. The second and fourth buttons can be vertically aligned on the user interface and proximate to the head section of the adjustable foundation. The user interface can also include a plurality of switches connected to the first, second, third, and fourth buttons, wherein pressing at least one of the first, second, third, and fourth buttons can include actuating at least one of the plurality of switches.

Embodiments described herein can also include a bed system having an adjustable foundation and a user interface. The adjustable foundation can include a head section, a foot section, and an actuation system connected to the head section and the foot section. The user interface can have a magnet and at least one button. The user interface can be communicatively coupled to the actuation system such that pressing the at least one button can signal the actuation system to adjust at least one of the foot section or the head section of the adjustable foundation.

In some implementations, the bed system can further include a mattress having a mattress cover, a head section, and a foot section, wherein the user interface can be retained to a side of the mattress cover by the magnet. The mattress cover can further include a fabric sewn to an interior of the mattress cover, wherein the fabric can have a ferrous metal positioned between the fabric and the interior of the mattress cover such that the magnet of the user interface can attach to the ferrous metal.

In other implementations, the bed system can have a user interface having means for signaling the actuation system to raise and lower the head section and the foot section of the adjustable foundation. The user interface can further include means for connecting the user interface to the adjustable foundation.

Some embodiments of a bed system having the external bed position controller can provide several advantages. For example, the external bed position controller can make it easier for a user to adjust the foundation to any desired position. Although remotes and/or mobile applications can provide for the foundation to be moved to preset positions, the external controller as described herein can provide for the user to move a portion of the foundation (e.g., a head section, a foot section) to any desired position, not just preset positions. For example, the user can raise and/or lower an adjustment bar on the controller to raise and/or lower a corresponding head or foot section of the foundation. As the user raises or lowers the adjustment bar, the corresponding section of the foundation moves, such that movement of the adjustment bar mimics or replicates movement of the foundation. The user can thus raise or lower each of the head and foot sections to any desired position. The user can also press one or more buttons on the controller that provide for moving the foundation to a preset position, such as a flat position or a favorite position.

The bed system described herein can also provide for simpler, faster, and easier operation of the adjustable foundation. The controller can be permanently (or semi-permanently) attached to the foundation or can alternatively be movably attached to the foundation. In embodiments in which the controller can be placed and moved along a side of the foundation, the user can move the controller to a location on the side of the foundation that is easiest and most comfortable for the user to access. Due to easier access, the user does not have to spend time trying to locate the controller to then adjust the foundation. When using a remote to adjust the foundation, the user has to locate the remote and then make a selection of a button on the remote. In other words, the user spends additional time locating the remote and reviewing and/or recalling functions for each of the buttons on the remote. Moreover, to adjust the foundation using a mobile application, the user has to locate a mobile device having the application, navigate user interfaces on the device to open the application, and then navigate the application itself in order to appropriately adjust the foundation. Thus, the user spends additional time before even adjusting the foundation.

The disclosed controller, on the other hand, can make it more intuitive, faster, and easier to adjust the foundation. The user merely has to reach an arm down to the side of the foundation where the user positioned the controller. Then, the user can raise or lower portions of the adjustment bar to raise or lower corresponding portions of the foundation. Operation of the disclosed controller can be faster than operating the remote and/or mobile application. Operation of the disclosed controller can also be simplified, which can benefit users who do not have as much experience with remotes and/or mobile applications or mobile devices. For example, elderly users can more easily adjust their foundations using the disclosed controller because the elderly users merely need to move the adjustable bar in a direction that they want portions of the foundation to be moved. The elderly users would not have to rely on other people to make adjustments to the foundation, nor would the elderly users have to learn how to use a remote or mobile application to adjust their foundations.

As mentioned, design of the disclosed controller can be intuitive, which makes operation of such controller easier. Raising or lowering portions of the adjustment bar can mimic raising or lowering head and/or foot portions of the foundation. For example, if the user wants to lower the foot portion of the foundation, the user can merely push down on or lower the portion of the adjustment bar that corresponds to the foot section of the foundation. This design can benefit a range of users, including the elderly, who may have difficulty learning new controls associated with remotes and/or mobile applications. With the design of the disclosed controller, the users can intuitively use the adjustment bar to replicate the movement they would like in their foundations.

Additionally, positioning portions of the adjustable bar on the controller proximate to corresponding head and foot sections of the foundation can be beneficial to improve intuitive use of such controller. For example, a portion of the adjustment bar that corresponds to the head section of the foundation can be positioned/located closer to the head section of the foundation while a portion of the adjustment bar that corresponds to the foot section of the foundation can be positioned/located closer to the foot section of the foundation. Because of the location of such portions of the adjustable bar, the user can adjust the corresponding head and foot sections without having to look at the controller; the user can understand that the portion closest to them can be associated with the head section of the foundation while the portion farthest away from them can be associated with the foot section of the foundation.

As mentioned, the controller can also be moved by the user to different locations along sides of the foundation. The user can determine a desired location of the remote such that it is easy and comfortable to reach. A smaller user can, for example, prefer to have the controller positioned closest to the head section of the foundation while a taller user can prefer to have the controller moved closer to a middle of the foundation.

The adjustment bar can be recessed in the controller such that the bar cannot be accidentally actuated by a person, object, and/or furniture that may be positioned near the foundation. This configuration can be advantageous to prevent the foundation from being mistakenly adjusted to a position that is not desired by the user. One or more additional buttons, switches, and/or bars can also be recessed in the controller to achieve a similar advantage.

Additionally and/or alternatively, because the adjustment bar can be recessed in the controller, the bar may not protrude out from the side of the foundation. As a result, the adjustment bar and the controller itself may not obstruct furniture or other objects (e.g., side rails of a decorative bed frame made of wood or other materials) from being placed around or near sides of the foundation. The controller can maintain a low profile and not cause disturbances or obstructions. This can be advantageous for furniture arrangement in a room but also to maintain an aesthetically pleasing look of the bed system.

The controller itself can also be designed such that it remains flush against the side of the foundation so as to not protrude from the side of the foundation or to protrude only very little. Therefore, the controller may not cause disturbances, obstructions, or compromise an aesthetic look of the bed system.

A mattress can also include a cut-out region or recess in a bottom of the mattress such that a base of the controller can easily fit into that region. As a result, the mattress can flatten over the base of the controller and hold the controller in place. This configuration can also be beneficial to ensure that the mattress maintains a smooth and even profile that is flush to a top of the foundation. In other words, there may not be a bump or uneven portion of the mattress above a location where the base of the controller is inserted between the foundation and the mattress.

Additionally and/or alternatively, the controller can be attached to the side of the foundation via a magnet, which can make it easier to attach the controller and move the controller along the side of the foundation to a desired location. Therefore, a portion of the mattress may not have to be removed to accommodate for placement of the base of the controller between the mattress and the foundation. In other words, the mattress may not have to be modified to accommodate for the controller. The magnet controller can also be positioned flush against a mattress cover of the mattress, thereby maintaining a low profile and being non-obtrusive in the room environment. The magnet controller can even be positioned in an interior side of the mattress cover such that the controller is not visible but can still be easily located and used by the user to adjust the foundation. For example, the user can feel buttons, bars, or switches on the controller through the mattress cover, which the user can then actuate accordingly.

These and other embodiments can each optionally include one or more of the features described below. Particular embodiments of the subject matter described in this specification can be implemented so as to realize none, one, or more of the advantages described herein.

The details of one or more embodiments are set forth in the accompanying drawings and the description below. Other features, objects, and advantages of the invention will be apparent from the description and drawings, and from the claims.

DETAILED DESCRIPTION

In general, this disclosure describes an adjustable foundation, a mattress positioned on the adjustable foundation, and an external bed position controller. The controller can be mounted on a side of the foundation and/or a deck of the foundation. The controller can be used instead of a remote controller or mobile application to selectively adjust portions of the adjustable foundation. The controller can be communicatively coupled (e.g., by a wire, WIFI, etc.) to an adjustable foundation control system (e.g., actuation or articulation system).

Figure 1A:
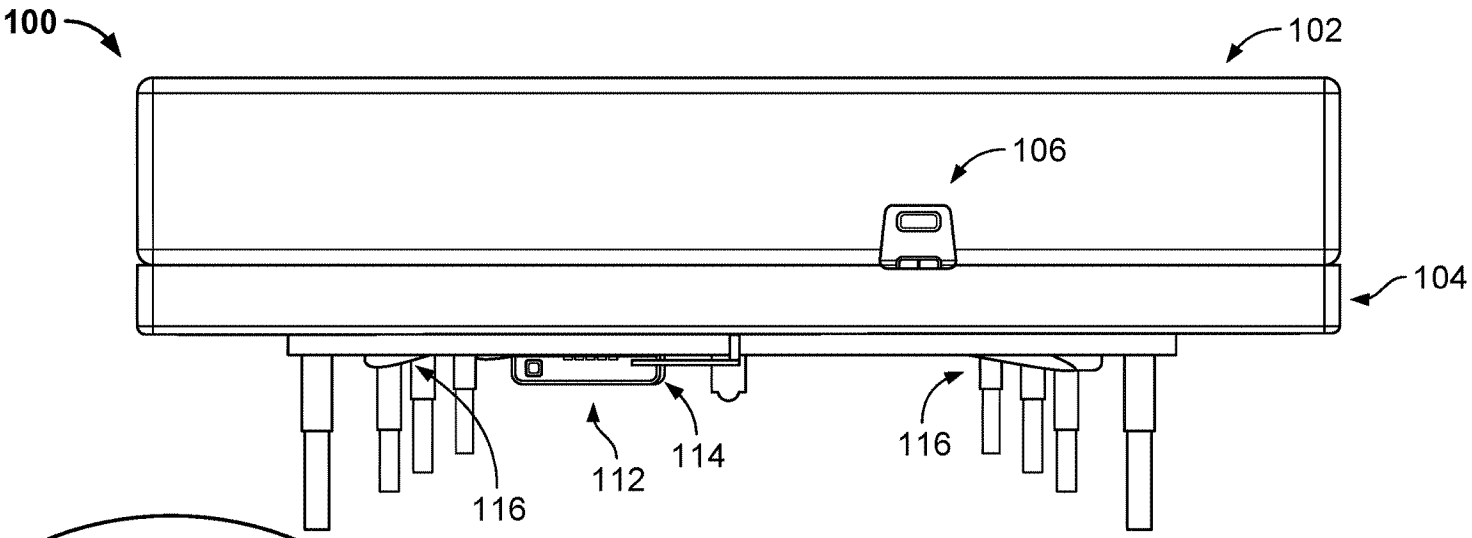
FIGS. 1A-B depict an embodiment of a bed system having a foundation, a mattress, and a user interface.
Figure 1B:
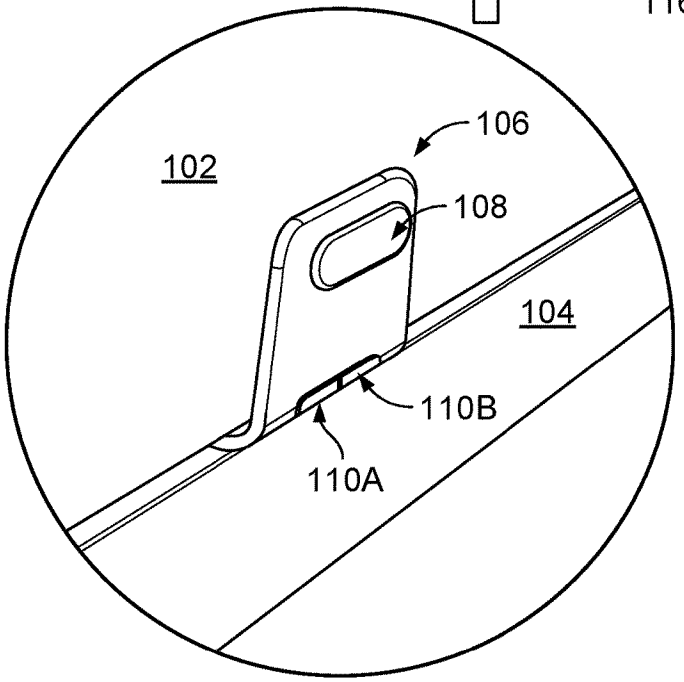
Figure 1C:
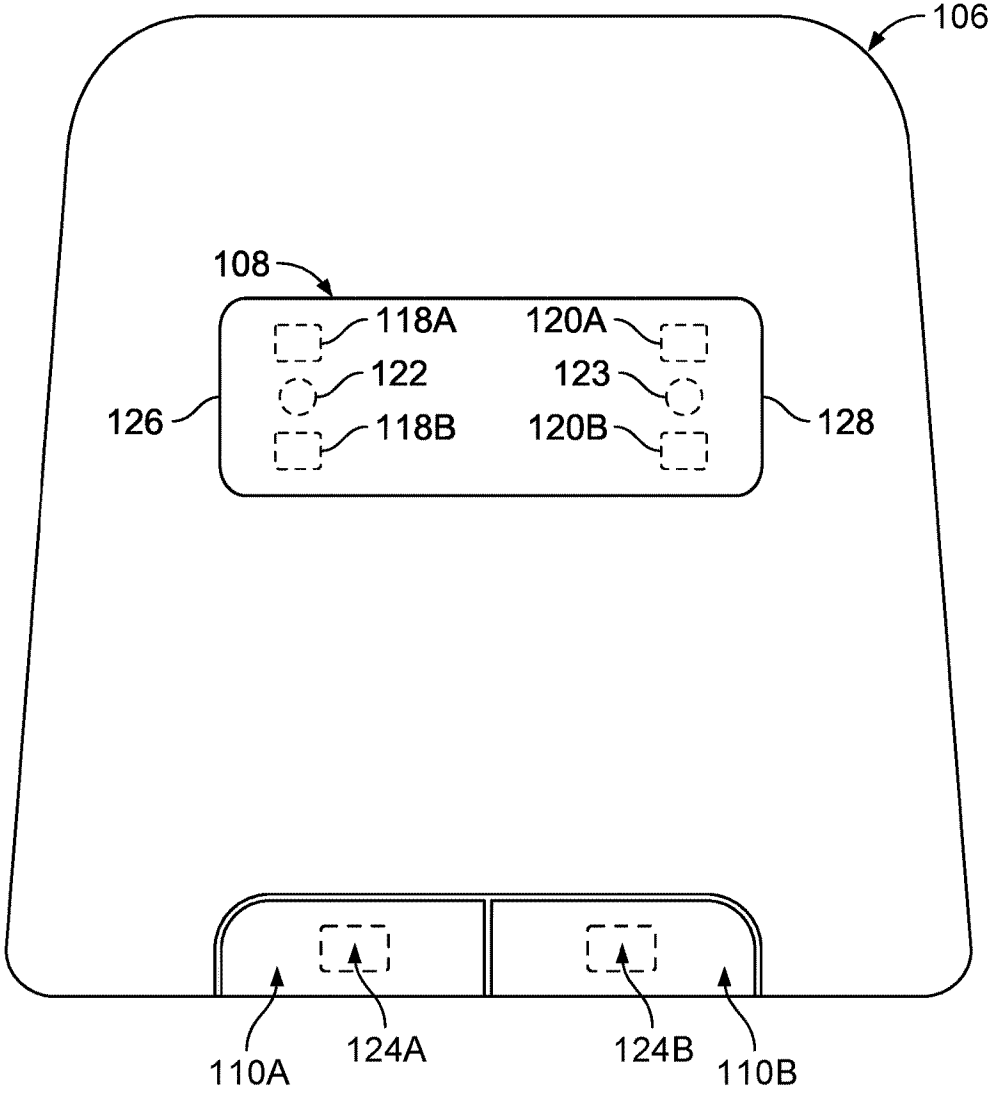
FIG. 1C is a schematic view of one embodiment of the user interface having a plurality of switches.

Referring to the figures, FIGS. 1A-B depict an embodiment of a bed system 100 having a foundation 104, a mattress 102, and a user interface 106 (e.g., external bed position controller). FIG. 1C is a schematic view of one embodiment of the user interface 106 having a plurality of switches 118A, 118B, 120A, 120B, 124A, and 124B. As shown in FIG. 1A, the foundation 104 can be an adjustable foundation for raising and lowering head and foot portions of the bed system 100. The foundation 104 includes the user interface 106 positioned on a side of the foundation 104. The foundation 104 further includes an articulation system 112 (e.g., actuation system) having a controller 114 and one or more actuators 116 configured to raise and lower portions of the foundation 104 in response to input signals received at the user interface 106.

As shown in FIG. 1B, one embodiment of the user interface 106 includes an adjustment bar 108 and buttons 110A and 110B. The adjustment bar 108 can be used to raise and lower the head and foot portions (e.g., sections) of the bed system 100. For example, the user can raise a portion of the adjustment bar 108 that is closest to the head section of the foundation 104 in order to raise the head section of the foundation 104. The user can lower the portion of the adjustment bar 108 that is closest to the head section of the foundation 104 in order to lower the head section of the foundation 104. Likewise, the user can raise a portion of the bar 108 that is closest to the foot section of the foundation 104 to raise the foot section. The user can lower the portion of the bar 108 that is closest to the foot section of the foundation 104 to lower the foot section. Arrangement of the adjustment bar 108 can be intuitive because portions of the bar 108 are located proximate to the sections of the foundation 104 that they actuate. Moreover, raising and lowering portions of the adjustment bar 108 can mimic actual raising and lowering portions of the foundation 104, which makes use of the adjustment bar 108 more intuitive and easier. The user can selectively raise or lower the head or foot sections of the foundation 104 by raising or lowering portions of the adjustment bar 108. In other examples, the user can raise or lower both head and foot sections simultaneously by raising or lowering the entire adjustment bar 108.

The buttons 110A and 110B can provide for adjustment of the bed system 100 to one or more preset positions. For example, the button 110A can be pressed in order to adjust the foundation 104 to a rest or flat position. The button 110B can be pressed in order to adjust the foundation to a preset favorite position of the user. In other implementations, the button 110A and/or 110B can provide for additional operation of the bed system 100 and/or peripheral devices. For example, the button 110A and/or 110B can be communicatively connected (e.g., wired and/or wireless) to a device such as a TV or lights. Upon pressing the button 110A and/or 110B, such device can be turned on and/or off. As another example, pressing the button 110A and/or 110B can result in actuating a massage feature in the bed system 100. Although not depicted, the user interface 106 can include additional and/or fewer buttons.

In some implementations (not shown), the user interface 106 can be integrated, built into, or otherwise attached to furniture, furniture surround, side rails of furniture, and/or a headboard of the bed system 100. In other implementations, the adjustable bar 108 can be attached to the furniture, furniture surround, side rails, and/or headboard of the bed system 100. Integration or attachment of the user interface 106 and/or the adjustable bar 108 as described can include (i) a magnet attach, (ii) a hollowed-out space in the furniture, surround, side rails, and/or headboard, (iii) a snapping feature, and/or any other suitable attachment or integration method.

FIG. 1C is a schematic view of one embodiment of the user interface 106 having the plurality of switches 118A, 118B, 120A, 120B, 124A, and 124B. In the illustrated embodiment, the adjustment bar 108 is connected to the switches 118A and 118B via a connector 122 and is connected to the switches 120A and 120B via a connector 123. The switches 118A and 120A can be up switches configured to raise head and foot sections of the foundation 104, respectively. The switches 118B and 120B can be down switches configured to lower head and foot sections of the foundation 104, respectively.

Actuation of the switch 118A raises the foot portion of the foundation 104 and actuation of the switch 118B lowers the foot portion of the foundation 104. Actuation of the switch 120A raises the head portion of the foundation 104 and actuation of the switch 120B lowers the head portion of the foundation 104. In other words, actuation of the switches 118A, 118B, 120A, and 120B signals the articulation system 112 to raise or lower sections of the foundation 104. The switches 118A, 1186, 120A, and 210B can therefore be communicatively coupled (e.g., wired or wireless) to the articulation system 112. Accordingly, pressing down on a foot end 126 of the adjustment bar 108 actuates the switch 118B, which in turn lowers the foot portion of the foundation 106. Pressing up on the foot end 126 of the adjustment bar 108 actuates the switch 118A, which in turn raises the foot portion of the foundation 106. Pressing down on a head end 128 of the adjustment bar 108 actuates the switch 120B, which in turn lowers the head portion of the foundation 106. Pressing up on the head end 128 of the adjustment bar 108 actuates the switch 120A, which in turn raises the head portion of the foundation 106. Accordingly, a user can raise or lower respective portions of the foundation 104 by moving a corresponding portion of the adjustment bar 108 in a direction that corresponds to the user's intended motion for the bed system 100.

FIG. 1C also shows the user interface 106 with the buttons 110A and 110B connected to the switches 124A and 124B. Pressing down on the buttons 110A and/or 110B actuates the switches 124A and/or 124B respectively, which in turn controls one or more operations of the bed system 100 or peripheral devices, as described herein. In some embodiments, the buttons 110A and 110B and the switches 124A and 124B can be omitted. In some embodiments, more or fewer buttons and switches can be included as suitable for the application.

Figure 2A:
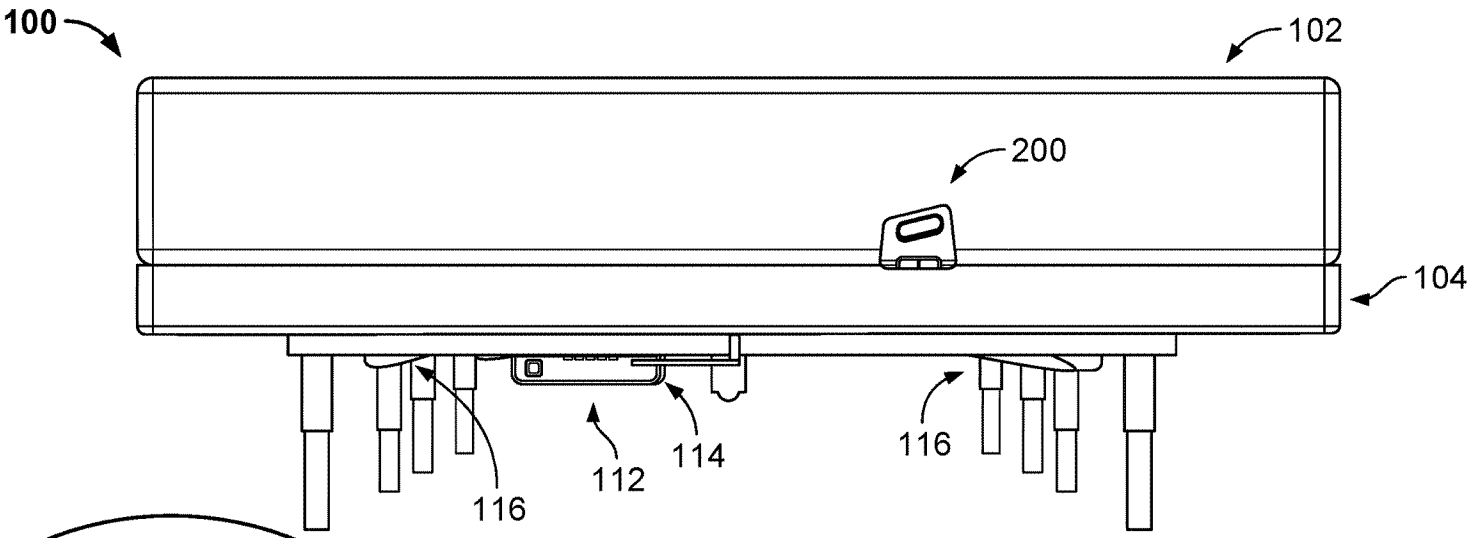
FIGS. 2A-B depict another embodiment of the bed system of FIG. 1.
Figure 2B:
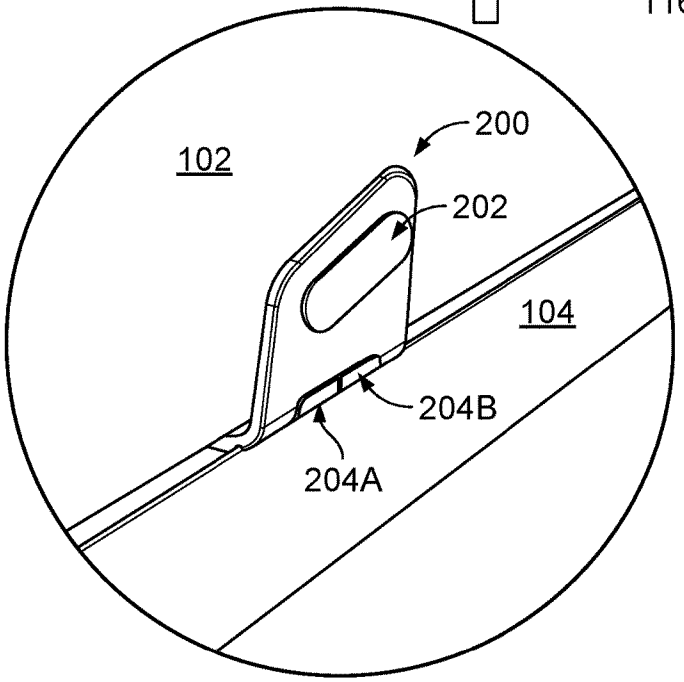

FIGS. 2A-B depict another embodiment of the bed system 100 of FIG. 1. The foundation 104 can be an adjustable foundation for raising and lowering head and foot portions of the bed system 100. The foundation 104 includes a user interface 200 positioned on a side of the foundation 104. The foundation 104 further includes the articulation system 112 having the controller 114 and one or more actuators 116 configured to raise and lower portions of the foundation 104 in response to input signals received at the user interface 200.

As shown in FIG. 2B, one embodiment of the user interface 200 includes an adjustment bar 202 and buttons 204A and 204B. The adjustment bar 202 can be used by a user to raise and lower the head and foot portions of the bed system 100, as described in reference to the adjustment bar 108 in FIGS. 1A-C. For example, the user can raise a portion of the adjustment bar 202 that is closest to the head section of the foundation 104 in order to raise the head section of the foundation 104. The user can lower the portion of the adjustment bar 202 that is closest to the head section of the foundation 104 in order to lower the head section. Likewise, the user can raise a portion of the bar 202 that is closest to the foot section of the foundation 104 to raise the foot section. The user can lower the portion of the bar 202 that is closest to the foot section of the foundation 104 to lower the foot section. As described in reference to the adjustment bar 108 in FIGS. 1A-C, the adjustment bar 202 can provide for intuitive and easy adjustment of the bed system 100 since movement of the bar 202 mimics actual intended movement of head and foot sections of the foundation 104.

Unlike the adjustment bar 108, the adjustment bar 202 can be sloped in an upward or downward direction such that it can be easier to locate and grab by the user. For example, a portion of the adjustment bar 202 that is sloped upwards can correspond to or mimic the head section of the foundation 104 while a portion of the adjustment bar 202 that is sloped downwards can correspond to or mimic the foot section of the foundation 104. Therefore, when the user grabs the adjustment bar 202, the user can intuitively recognize that the sloping upwards portion of the bar 202 corresponds to the head section of the foundation 104 and that the sloping downwards portion of the bar 202 corresponds to the foot section of the foundation 104. This can make it easier for the user to adjust the bed system 100 without having to look at the user interface 200 or learn how to use the user interface 200.

Moreover, as depicted, an upper portion of the user interface 200 is sloped to correspond to the slope of the adjustable bar 202. This design can be ergonomic and an aesthetically pleasing configuration.

The buttons 204A and 204B can provide for adjustment of the bed system 100 to preset positions, as described in reference to FIGS. 1A-C. The buttons 204A and/or 204B can also provide for additional operation of the bed system 100 and/or peripheral devices, as described herein.

The user interface 200 can have a plurality of switches, as described in reference to FIG. 1C. The adjustment bar 202 can be connected to one or more switches (e.g., up and down switches that correspond to the head section of the foundation 104 and up and down switches that correspond to the foot section of the foundation 104) via one or more connectors. The buttons 204A and 204B can also be connected to the switches. In some embodiments, the buttons 204A and 204B and the corresponding switches can be omitted. In some embodiments, more or fewer buttons and switches can be included as suitable for the application.

Figure 3A:
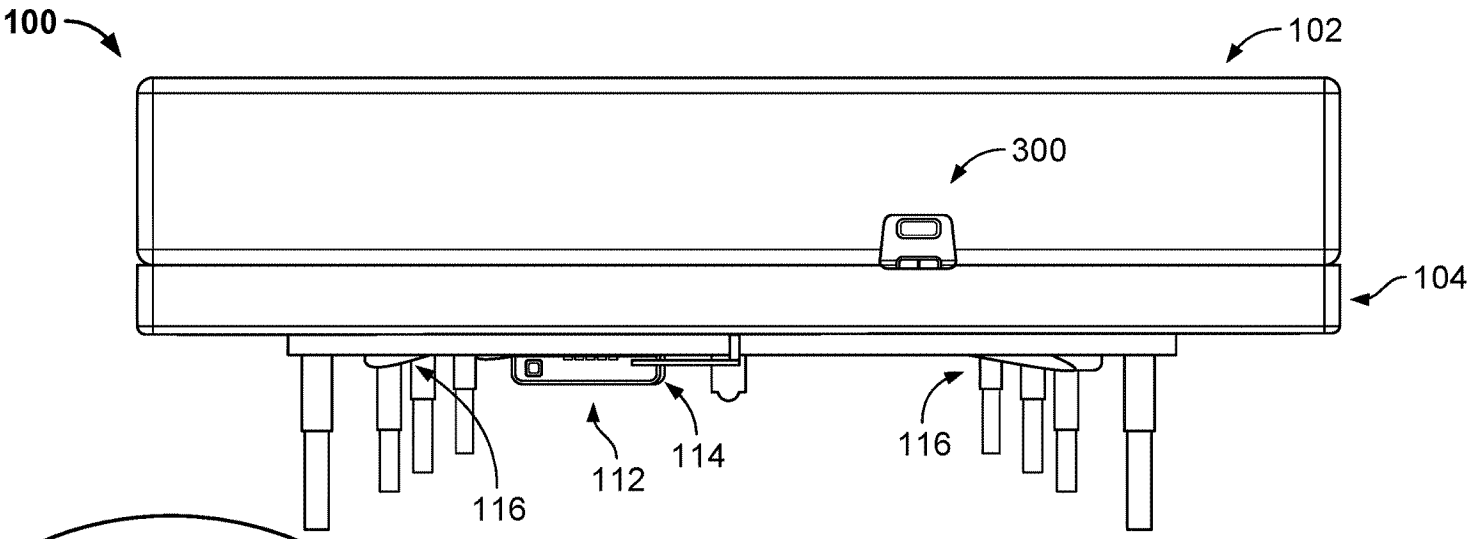
FIGS. 3A-B depict another embodiment of the bed system of FIG. 1.
Figure 3B:
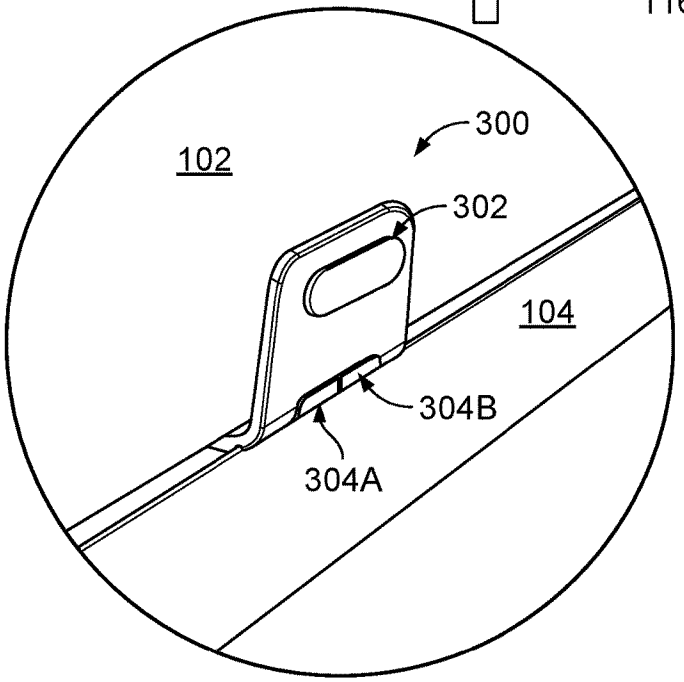

FIGS. 3A-B depict another embodiment of the bed system 100 of FIG. 1. The foundation 104 can be an adjustable foundation for raising and lowering head and foot portions of the bed system 100. The foundation 104 includes a user interface 300 positioned on a side of the foundation 104. The foundation 104 further includes the articulation system 112 having the controller 114 and one or more actuators 116 configured to raise and lower portions of the foundation 104 in response to input signals received at the user interface 300.

As shown in FIG. 3B, one embodiment of the user interface 300 includes an adjustment bar 302 and buttons 304A and 304B, as described in reference to FIGS. 1-2. Unlike the user interfaces 106 and 200, the user interface 300 can be smaller in size or height, thereby having a smaller profile. Smaller size of the user interface 300 can be beneficial for a bed system having a low profile or thinner mattress 102. On the other hand, where the mattress 102 is thicker or having a bigger profile, the user interface 106 of FIGS. 1A-C can be preferred, because the user interface 106 has a greater height or is larger in size. Therefore, the user interface 106 compensates for a thicker mattress because the user interface 106 has a greater height than the user interface 300. The adjustment bar 108 of the interface 106 is thereby positioned higher up along the side of the foundation 104 such that the user can comfortably grab the adjustment bar 108. As another example, a user having long arms can prefer the user interface 300 because it can be more comfortable for the user to stretch their arms to the user interface 300 having the smaller height or size. On the other hand, a user having shorter arms can prefer the user interface 106 because the user cannot stretch their arms to reach the adjustment bar 302 and the buttons 304A and 304B of the user interface 300. Different sized user interfaces can be advantageous because the user can choose a user interface based on personal preference and use it with whatever bed system they desire. Functionality of the user interface is not compromised regardless of which sized user interface the user selects and which bed system the selected user interface is attached or added to.

The buttons 304A and 304B can provide for adjustment of the bed system 100 to preset positions, as described in reference to FIGS. 1-2. The buttons 304A and/or 304B can also provide for additional operation of the bed system 100 and/or peripheral devices, as described herein.

The user interface 300 can have a plurality of switches, as described in reference to FIGS. 1-2. The adjustment bar 302 can be connected to one or more switches via one or more connectors. The buttons 304A and 304B can also be connected to one or more switches. In some embodiments, the buttons 304A and 304B and the corresponding switches can be omitted. In some embodiments, more or fewer buttons and switches can be included as suitable for the application.

Figure 4A:
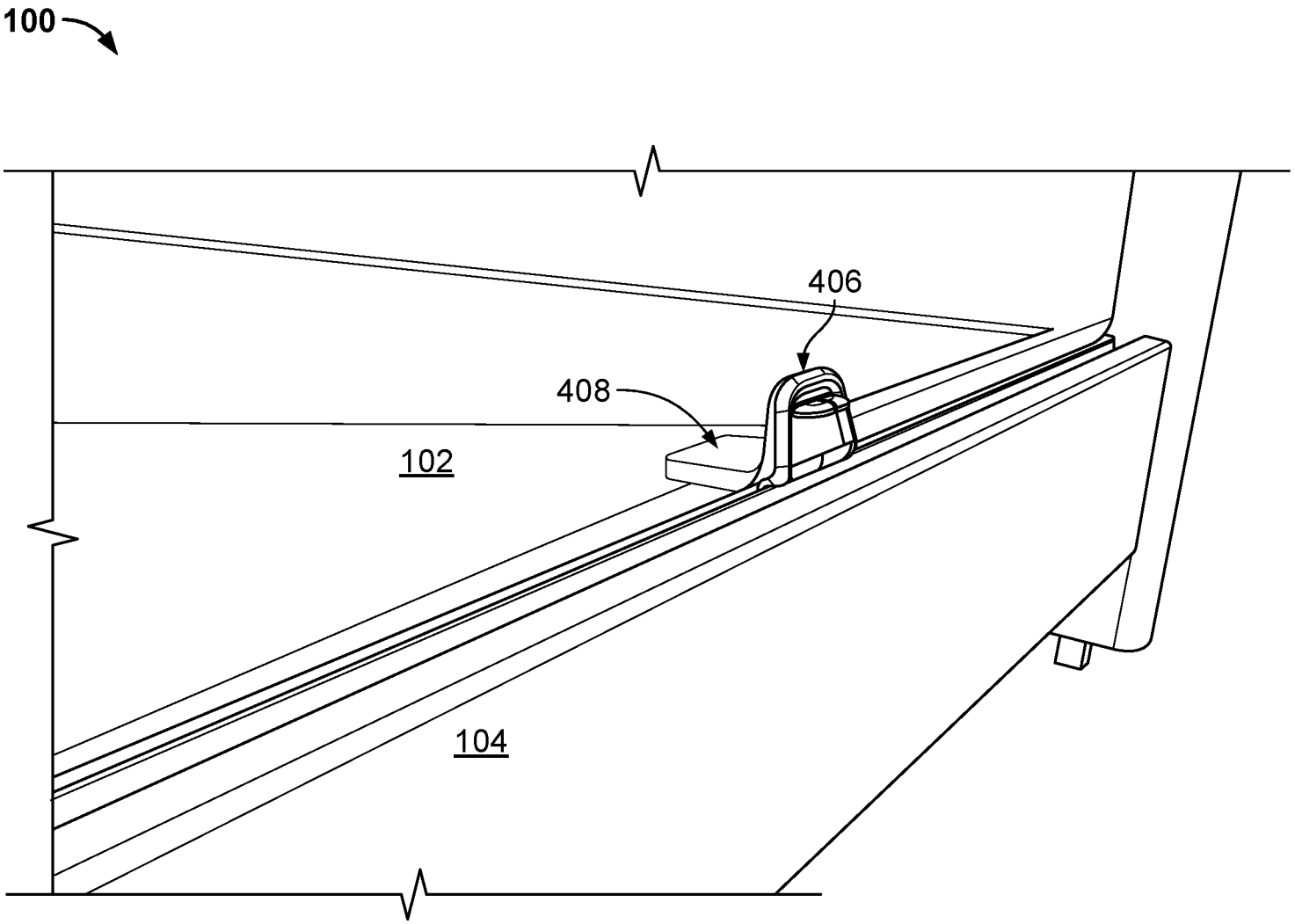
FIGS. 4A-B depict one embodiment of a user interface when the bed system of FIG. 1 is in a lowered position.
Figure 4B:
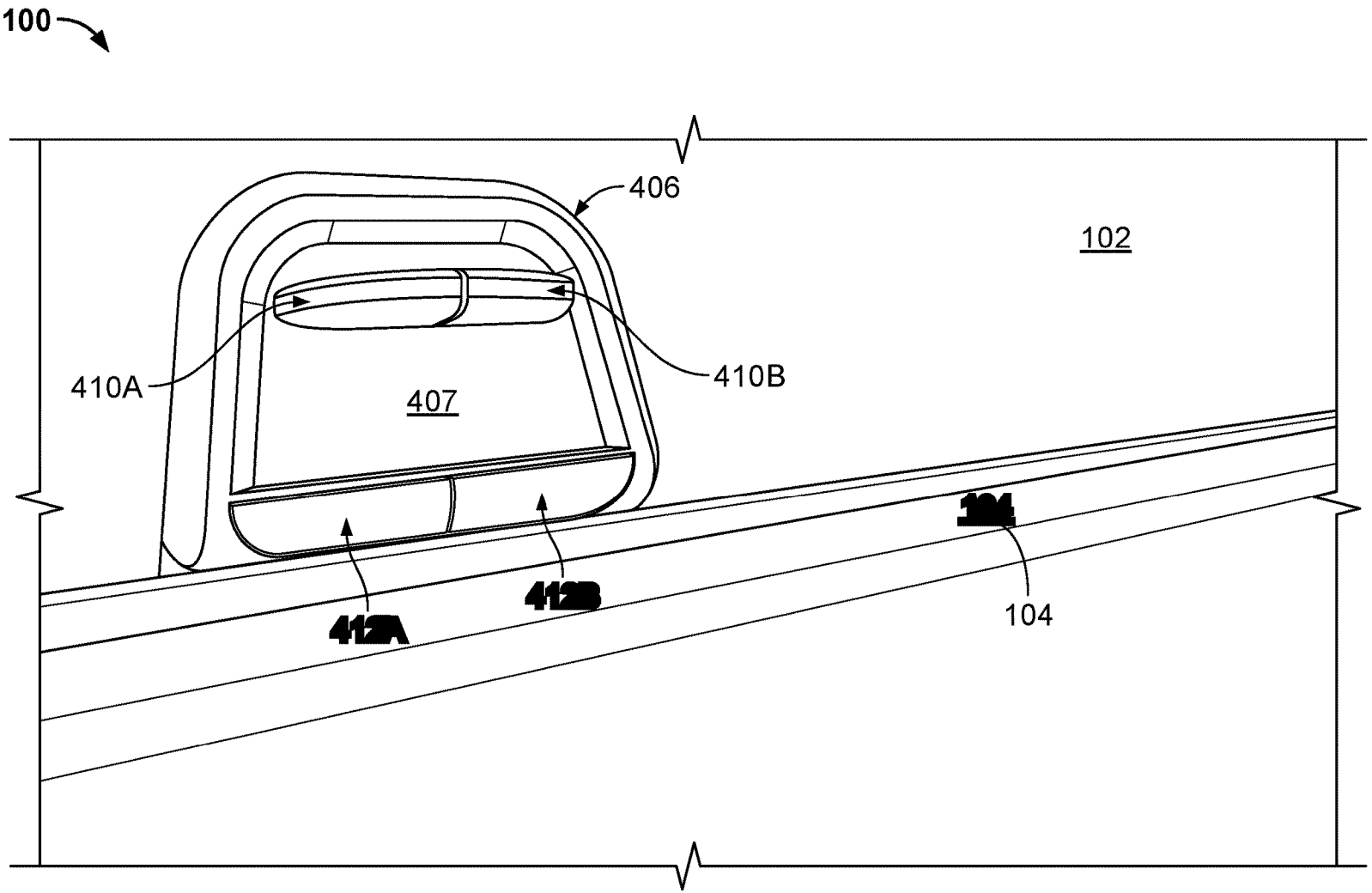

FIGS. 4A-B depict one embodiment of a user interface 406 when the bed system 100 of FIG. 1 is in a lowered or flat position. As depicted in FIG. 4A, the user interface 406 is positioned along a side of the foundation 104. The user interface 406 has a base 408 (e.g., bracket) that protrudes from a back of the user interface 406. In some embodiments, the base 408 slides or is positioned between a top of the foundation 104 and a bottom of the mattress 102. As a result, the user interface 406 can be held in place between the mattress 102 and the foundation 104. The user interface 406 can be flush with the side of the foundation 104. This configuration can be beneficial to reduce the chance of the interface 406 causing obstructions with users walking by the side of the foundation 104, the mattress 102, and/or furniture that is placed next to the bed system 100.

Moreover, the mattress 102 can be shaped to receive the base 408 of the user interface 406. Some example mattresses can include a cut-out region in the bottom of the mattress where foam or other materials from the mattress are removed to form a recess for receiving the base 408. This can insure that a portion of the mattress that goes over the base 408 is not sticking up or uneven compared to the rest of the mattress. Including a cut-out region can help assist a user in positioning the mattress on the foundation 104 with the cut-out region aligned with the base 408. As another example, the bottom of the mattress can include indicators or some form of designations (e.g., arrows, stitching, etc.) that indicate where the base 408 can be placed and secured between the mattress 102 and the foundation 104. In yet other examples, the base 408 can be placed along a side of the mattress 102 at any (or nearly any) location between the mattress 102 and the foundation 104 that is preferred by the user. By using a relatively short/low profile of the base 408, placement of the base 408 at any location preferred by the user may not cause a portion of the mattress above the base 408 to be uneven.

As shown in FIG. 4B, the user interface 406 has a recessed region 407 in which adjustment bars 410A and 410B are connected to the user interface 406. The recessed region 407 can be advantageous to reduce the chance of the adjustment bars 410A and 410B being accidently hit or moved by the user or any furniture that is positioned near the bed system 100. Each of the adjustment bars 410A and 410B can be raised and lowered as described in reference to the adjustment bar 108 in FIGS. 1A-C. For example, the adjustment bar 410A can be raised or lowered to signal to an articulation system to raise or lower the corresponding foot section of the foundation 104. Likewise, the adjustment bar 410B can be raised or lowered to signal to an articulation system to raise or lower the corresponding head section of the foundation 104. The adjustment bar 410A can be located closer to the foot section of the foundation 104 and the adjustment bar 410B can be located closer to the head section of the foundation 104 to facilitate intuitive operation.

The user interface 406 can also include buttons 412A and 412B, as described throughout this disclosure. The user interface 406 can also have a plurality of switches, as described in reference to FIGS. 1-3. For example, the adjustment bar 410A can be connected to first and second switches via a connector. Raising the bar 410A can actuate the first switch, which in turn signals the articulation system to raise the foot section of the foundation 104. Lowering the bar 410A can actuate the second switch, which in turn signals the articulation system to lower the foot section of the foundation 104. The adjustment bar 410B can be connected to third and fourth switches via a connector. Raising the bar 410B can actuate the third switch, which in turn signals the articulation system to raise the head section of the foundation 104. Lowering the bar 410B can actuate the fourth switch, which in turn signals the articulation system to lower the head section of the foundation 104. The buttons 412A and 412B can also be connected to one or more switches. In some embodiments, the buttons 412A and 421B and the corresponding switches can be omitted. In some embodiments, more or fewer buttons and switches can be included as suitable for the application.

Figure 4C:
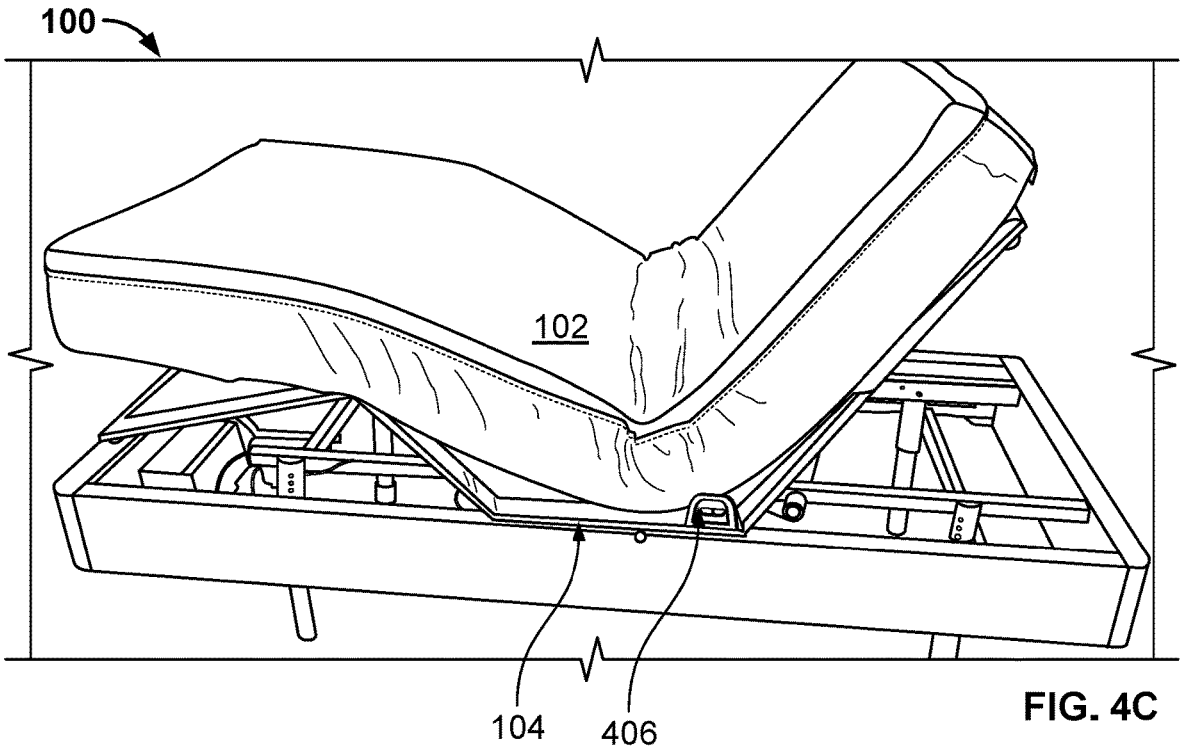
FIGS. 4C-D depict one embodiment of the user interface when the bed system of FIG. 1 is actuated.
Figure 4D:
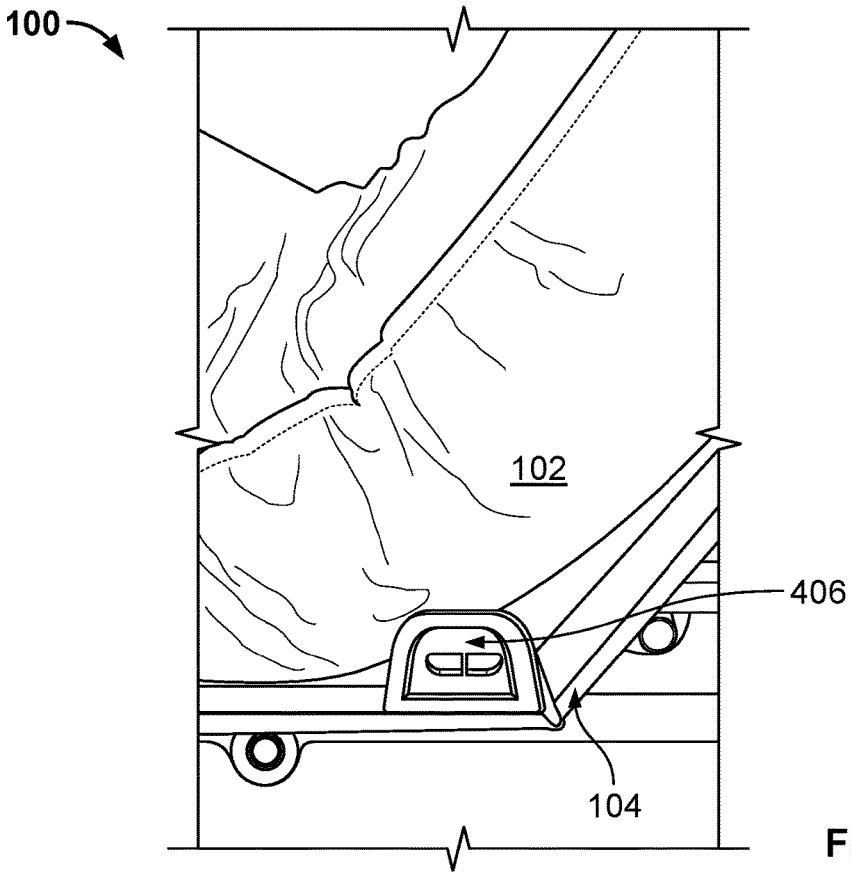

FIGS. 4C-D depict one embodiment of the user interface 406 when the bed system 100 of FIG. 1 is actuated. When the head and foot sections of the foundation 104 are raised using the user interface 406, corresponding portions of the mattress 102 can also be raised. Furthermore, even where the bed system 100 is actuated, the user interface 406 can remain stationary with respect to the side of the foundation 104. The interface 406 also does not obstruct movement of the foundation 104 or the mattress 102. The interface 406 can remain in the same position such that it is easy for the user to locate it and adjust the foundation 104. The interface 406 can continue to be used intuitively no matter a position of the head or foot section of the foundation 102.

Figure 5A:
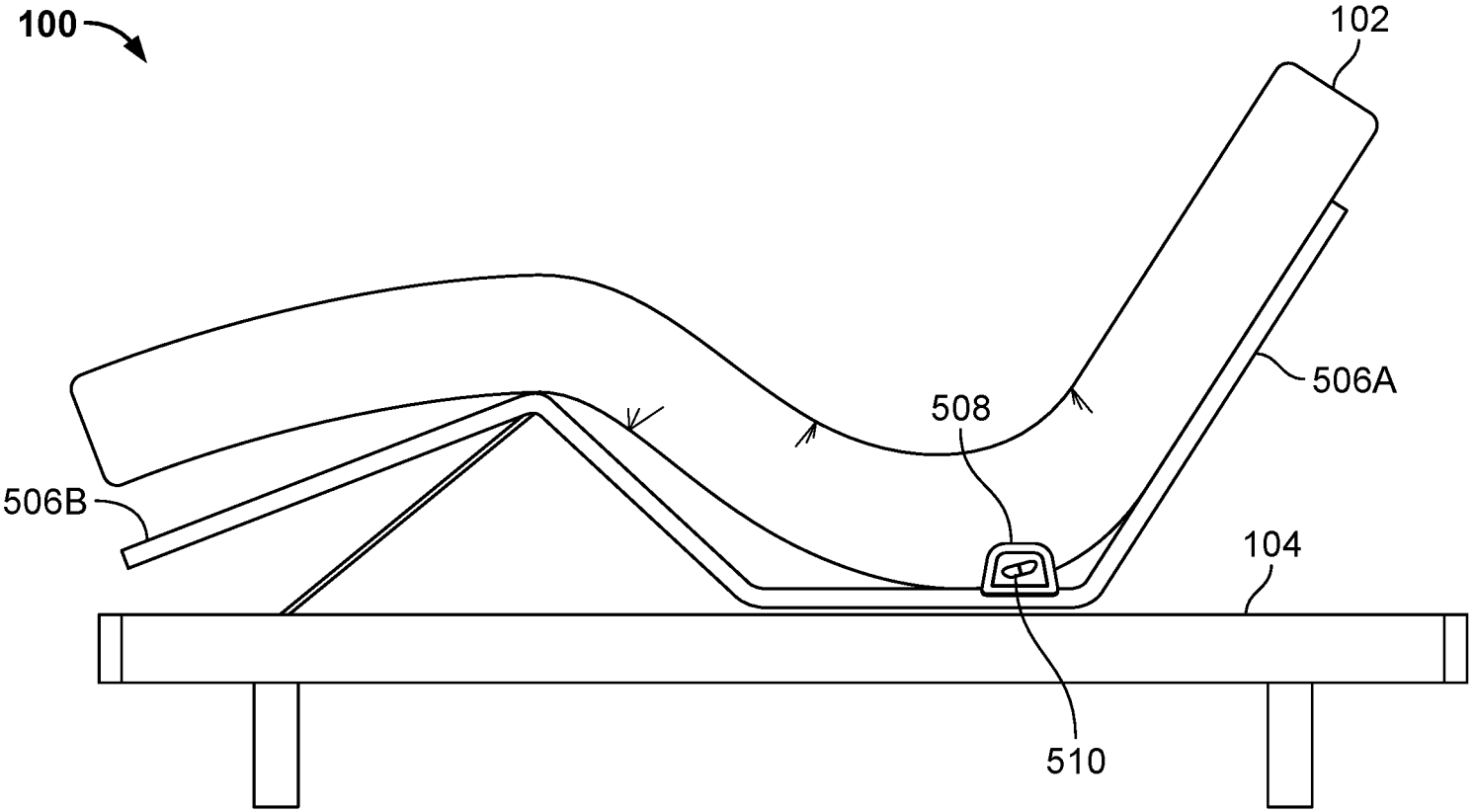
FIGS. 5A-B depict a schematic view of one embodiment of a user interface of the bed system of FIG. 1.
Figure 5B:
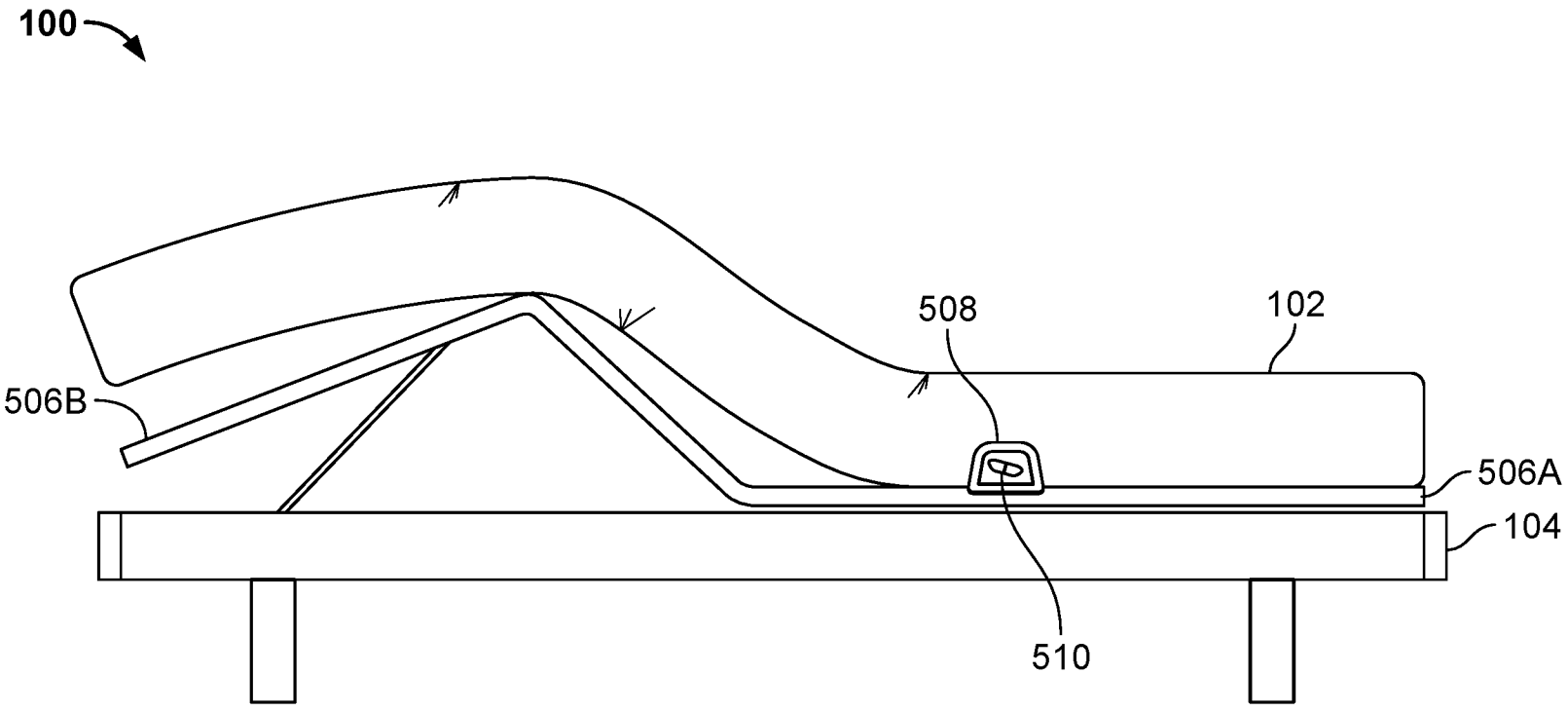

FIGS. 5A-B depict a schematic view of one embodiment of a user interface 508 of the bed system 100 of FIG. 1. The bed system 100 has the mattress 102 positioned on top of the adjustable foundation 104. The adjustable foundation 104 includes a head section 506A (including a head panel) and a foot section 506B (including a foot panel). Each of these sections 506A and 506B can be actuated (e.g., raised and lowered) by an articulation system as described herein. The user interface 508 includes an adjustment bar 510 (e.g., refer to FIGS. 1-3). The user interface 508 can be attached to a side of the foundation 104 in a user-desired location or in a stationary location. As described throughout, the user interface 508 can be communicatively connected to the articulation system so that the user can adjust the foundation 104 by raising or lowering the adjustment bar 510 on the interface 508.

In FIG. 5A, the head section 506A is raised and the foot section 506B is also raised. The adjustment bar 510 is shown in FIG. 5A in a position for raising the head section 506A. In other words, a portion of the adjustment bar 510 that is closest to the head section 506A corresponds to adjusting the head section 506A and is inclined, much like the head section 506A. The user can raise the portion of the bar 510 closest to the head section 506A in order to raise the section 506A. Movement of this portion of the bar 510 resembles movement of the head section 506A. In FIG. 5B, the head section 506A is in a flat position relative to the head section 506B, which is raised. The portion of the adjustment bar 510 that is closest to the head section 506A is sloped downwards in a position conducive to lowering the head section 506A. The user can lower the portion of the bar 510 closest to the head section 506A in order to lower the section 506A. Movement of this portion of the bar 510 therefore resembles movement of the head section 506A. Therefore, the adjustment bar 510, as depicted in FIGS. 5A-B, has a pivot in a center of the bar 510 such that raising or lowering either portion of the bar 510 raises or lowers the respective section 506A or 506B.

Figure 6:
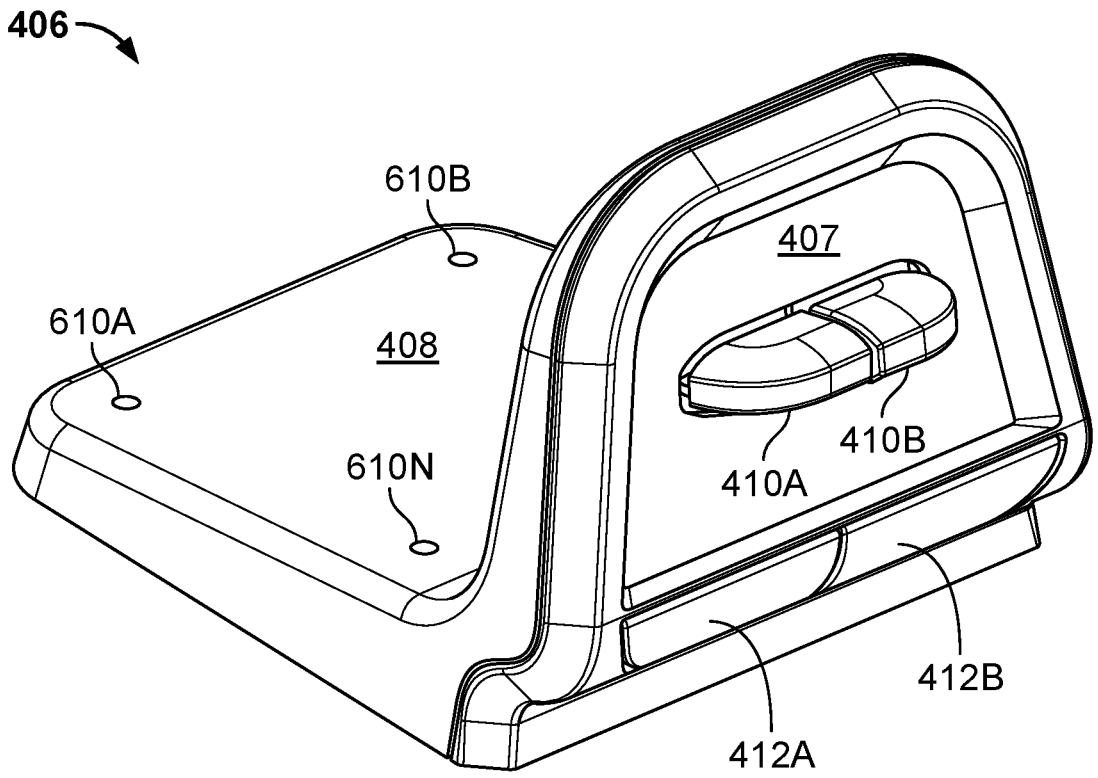
FIG. 6 depicts one embodiment of the user interface of FIG. 1.

FIG. 6 depicts one embodiment of the user interface 406 of FIG. 1. As described in reference to FIGS. 4A-D, the user interface 406 includes adjustment bars 410A and 410B. The bars 410A and 410B are located in the recessed region 407 of the user interface 406. The interface 406 further includes the buttons 412A and 412B. As described in reference to FIG. 1C, the user interface 406 can further include a plurality of switches connected to the bars 410A and 410B and/or the buttons 412A and 412B. Raising or lowering the bars 410A and 410B and pressing the buttons 412A and 412B can cause actuation of at least one of the plurality of switches, which in turn signals the articulation system to adjust the bed system 100 accordingly.

The buttons 412A and 412B can provide for different operations of an adjustable foundation or bed system. For example, the buttons 412A and 412B can be set to raise or lower the entire foundation, change firmness of a mattress, adjust to a favorite/preset position, reset to a flat position, actuate a massage feature, actuate lumbar support, and/or control one or more peripheral devices (e.g., lights, TV, alarm, etc.). The user can configure the buttons 412A and 412B functionality.

The user interface 406 can be communicatively coupled (e.g., wired, wireless) to the articulation system of the foundation, as described herein. As a result, when the user presses down on the adjustment bar 410A, for example, a switch of the plurality of switches is actuated, causing a signal to be communicated to the articulation system to lower the foot portion of the foundation. Likewise, when the user presses one or more of the buttons 412A and 412B, a switch of the plurality of switches is actuated, causing the signal to be communicated to the articulation system (or peripheral device) to perform an operation associated with pressing the button 412A or 412B.

The interface 406 has the base 408 (e.g., bracket), which can be inserted between a mattress and a foundation to retain the user interface 406 flush with or near a side of the foundation. The base 408 can include one or more (e.g., four) fastener holes 610A-N to receive fasteners, such as screws, bolts, or other suitable fasteners, to retain the base 408 to a top of the foundation. In some examples, the fastener holes 610A-N need not be included. Instead, the base 408 can be maintained in a position between the mattress and the foundation based on weight of the mattress on top of the base 408. As a result, the user interface 406 can be relatively easily moved along the side of the foundation to the user's desired location.

In some embodiments, the base 408 can be configured to attach the user interface 406 to a bed system not specifically designed for use with the user interface 406. In other words, the user interface 406 can be an add-on attachment for one or more bed systems. The base 408 can be fitted between a mattress and foundation of varying sizes to control operations of various different bed systems (e.g., king, queen, full-sized). The base 408 can also retain the user interface 406 near the side of the foundation and near the mattress such that use of the interface 406 is less obstructed by other furniture. Thus, the foundation, with the user interface 406, can be positioned inside a user's furniture, such as a decorative bed frame. Such a decorative bed frame can have rails or other structures that could interfere with access to controls positioned lower, on the side of a foundation yet that does not interfere with access to the user interface 406 that is positioned higher, adjacent a side of the mattress. Therefore, where the user interface 406 is retained against the side of the foundation by the base 408 being positioned between the mattress and the foundation, the user interface 406 can be elevated to a position that is not interfered with by any components of the user's furniture.

Figure 7:
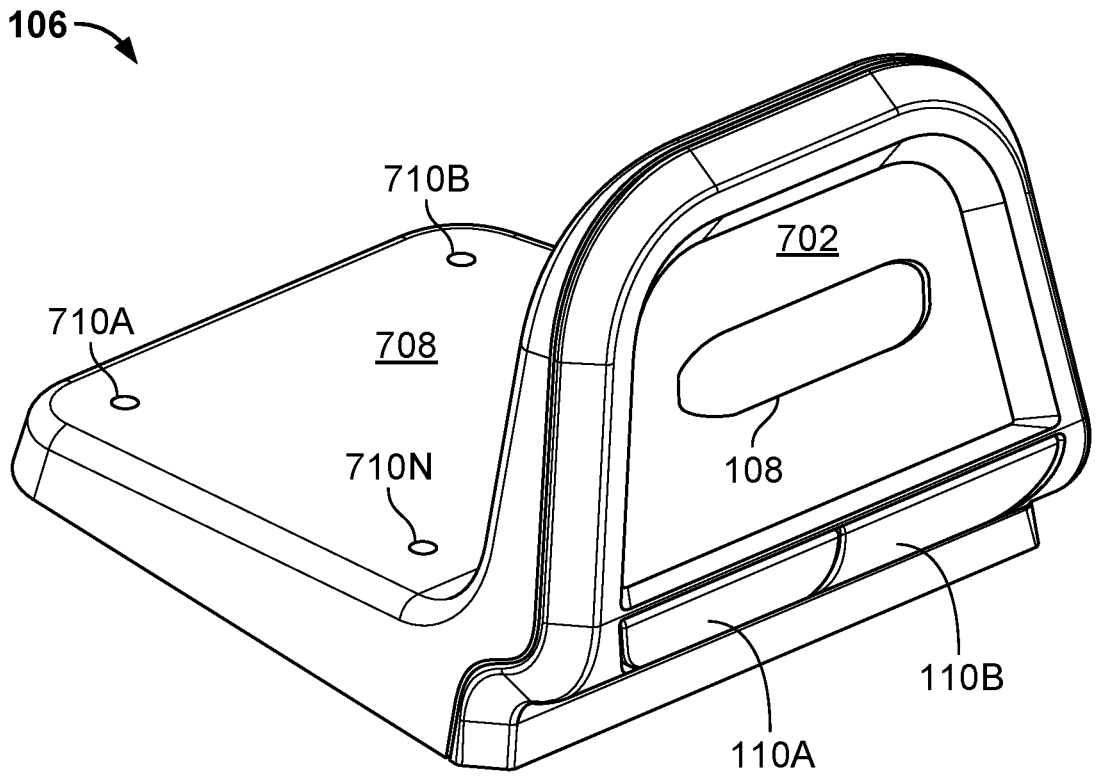
FIG. 7 depicts another embodiment of the user interface of FIG. 1.

FIG. 7 depicts another embodiment of the user interface 106 of FIG. 1. As depicted and described throughout this disclosure, the user interface 106 includes at least one adjustment bar 108. The bar 108 can be a single rigid bar including both a head portion and a foot portion. In some examples, the bar 108 can include first and second bars that are hingedly connected at central portions of the first and second bars. The bar 108 can be positioned in a recessed region 702 of the user interface 106. Moreover, the interface 106 can include one or more of the buttons 110A and 110B. The user interface 106 includes a base 708 for retaining the interface 106 against a side of the foundation. As previously described, the base 708 can be positioned between a bottom of a mattress and a top of a foundation. The base 708 can be retained to the top of the foundation via one or more fasteners 710A-N (e.g., screws).

In some examples, as described in reference to FIG. 1C, the interface 106 can include a plurality of switches that are connected to portions of the adjustment bar 108 and the buttons 110A and 110B. For example, by raising a portion of the adjustment bar 108, a switch can be pivoted up, which sends a signal to the actuation (e.g., articulation) system to raise the corresponding section of the foundation. By lowering a portion of the adjustment bar 108, another switch can be pivoted down, which sends a signal to the actuation system to lower the corresponding section of the foundation. In other examples, each portion of the adjustment bar 108 can be connected to a two-way momentary switch, rather than up and down switches. In yet other examples, instead of actuating switches when raising or lowering portions of the adjustment bar 108, the bar 108 can have a hinge at its center such that the bar 108 can rotate. Therefore, when the user raises a portion of the bar, the bar 108 rotates by the hinge and mimics or resembles movement of the corresponding section of the foundation.

In some embodiments, the adjustment bar 108 can be associated with raising or lowering only one section of the foundation. For example, the adjustment bar 108 can be configured to raise or lower only the head section of the foundation. An additional bar and/or an additional user interface can be used to raise or lower only the foot section of the foundation. Moreover, one or more of the buttons 110A and 110B can be used to switch between using the adjustment bar 108 for actuating the head section and the foot section of the foundation.

Figure 8:
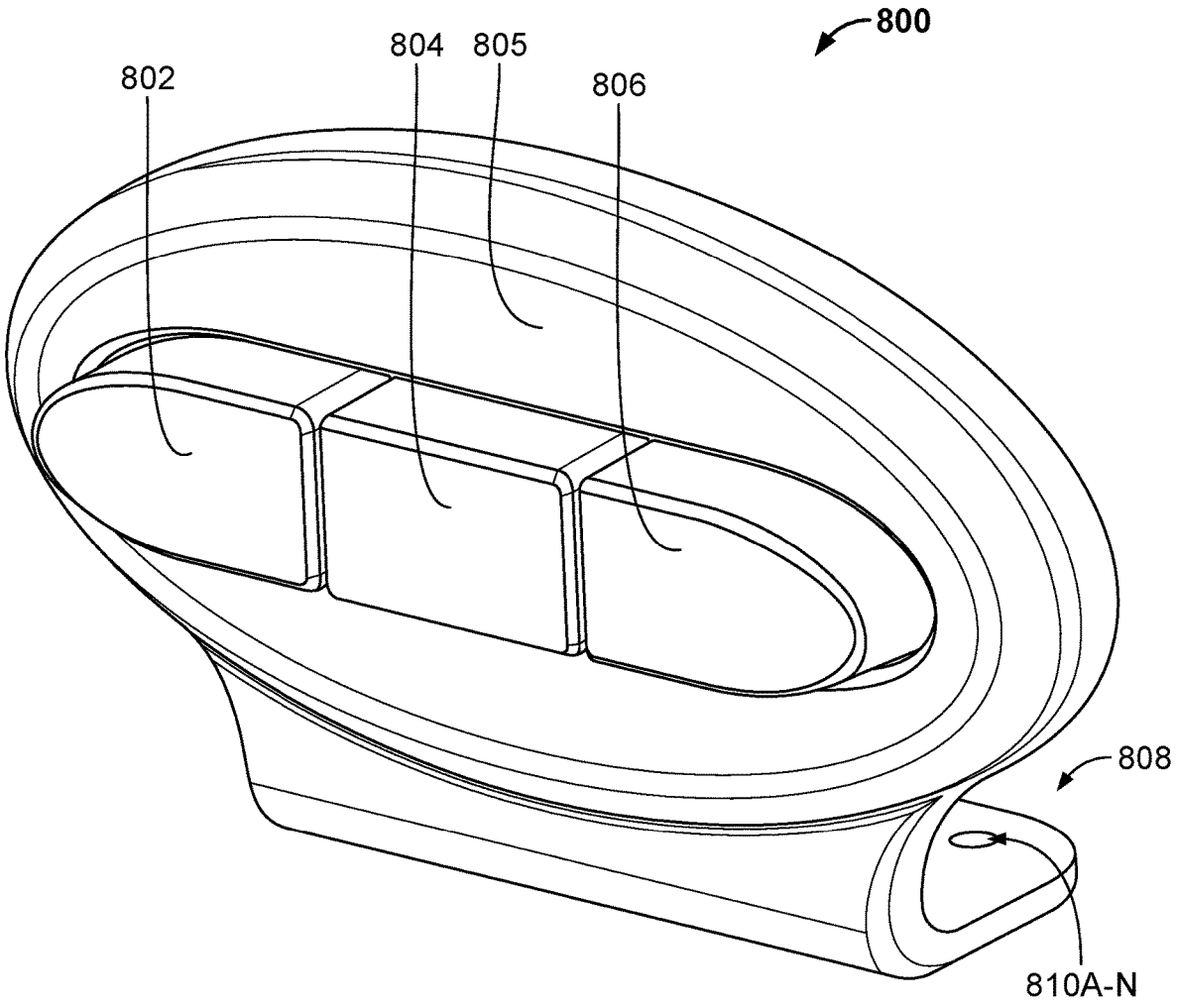
FIG. 8 depicts another embodiment of a user interface.

FIG. 8 depicts another embodiment of a user interface 800. The user interface 800 includes an extended region 805 having one or more buttons 802, 804, and 806. In other examples, the buttons 802, 804, and 806 can be one or more adjustment bars or a combination of adjustment bars and buttons. The extended region 805 can make it easier for the user to locate the buttons 802, 804, and 806 and press them. In other examples, the user interface 800 can have a recessed region instead of the extended region 805. As described herein, the user interface 800 can also include a plurality of switches that are connected to the buttons 802, 804, and 806. When the buttons 802, 804, and 806 are pressed, the switches can be activated, thereby signaling an articulation system to raise or lower corresponding portions of a foundation and/or perform other functions of a bed system.

The button 802 can be configured to control adjustment of a foot section of the foundation. The button 806 can be configured to control adjustment of a head section of the foundation. The button 804 can be configured to move the foundation to a preset or favorite position or to reset the foundation to a flat position. In some examples, the buttons 802 and 806 can be connected to two switches each. Therefore, when the user presses the button 802 up, for example, an upper switch is actuated to signal the actuation system to raise the foot section of the foundation. When the user presses the button 802 down, a lower switch is actuated to signal the actuation system to lower the foot section of the foundation. The button 804 can also be connected to up and down switches so that the button 804 can have dual functionality. Moreover, in some examples, the button 804 can be configured to control adjustment of another section of the foundation. For example, the foundation can have a mid or lower back and/or legs section (e.g., panel) that can be actuated independently from the head and foot sections of the foundation. This section can be actuated using the button 804.

In some embodiments, the buttons 802 and 806 can be used to adjust only one section of the foundation. For example, the button 802 can be configured to lower the head section of the foundation and the button 806 can be configured to raise the head section of the foundation. Moreover, the button 804 can be configured to allow the user to switch between controlling adjustment of the head and foot sections of the mattress. For example, the buttons 802 and 806 can be initially configured to provide for control of the head section of the foundation. When the user presses the button 804, the buttons 802 and 806 can be re-configured to provide for control of the foot section of the foundation.

As depicted, the user interface 800 can also include a base 808 for retaining the interface 800 against a side of the foundation. The base 808 can be positioned between a mattress and a foundation. One or more fastener holes 810A-N (e.g., screw or bolt holes) can be used to retain the base 808 in place on a top of the foundation. The base 808 can be any length suitable to stabilize and maintain the base 808 in a secure position flush against the side of the foundation.

Figure 9:
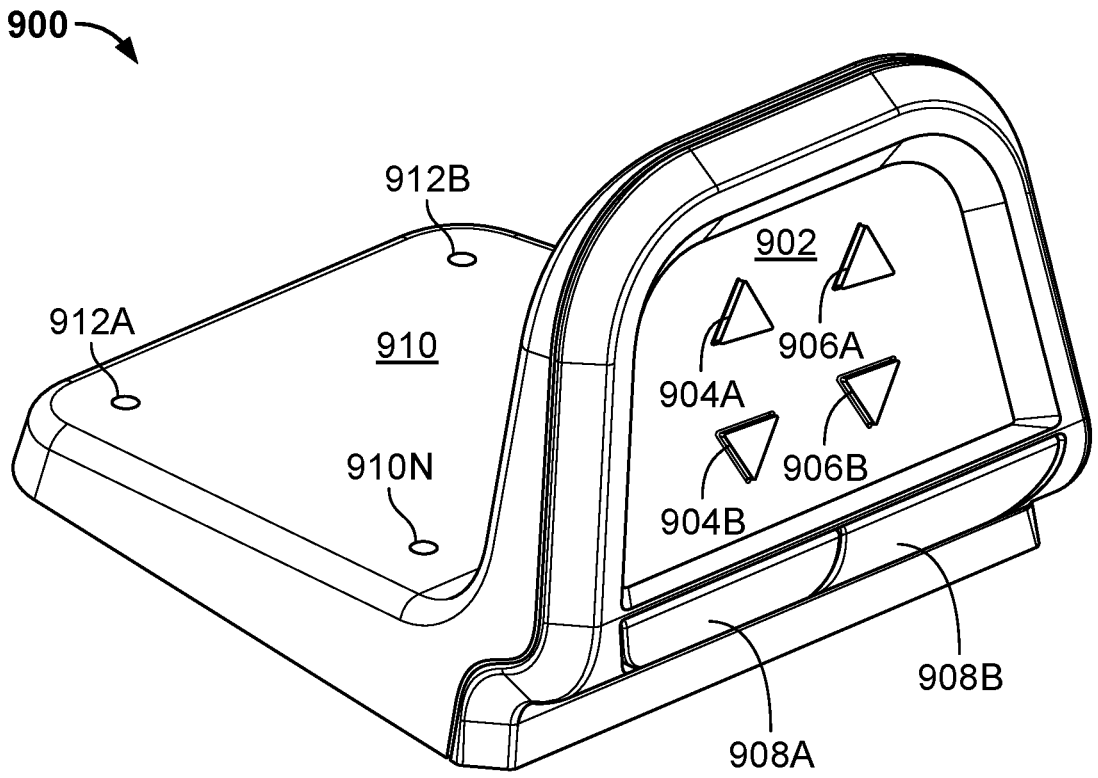
FIG. 9 depicts another embodiment of a user interface.

FIG. 9 depicts another embodiment of a user interface 900. The user interface 900 includes buttons 904A, 904B, 906A, and 906B positioned in a recessed region 902. Each set of buttons can be configured to control a different portion of a foundation. For example, the buttons 904A and 904B can be configured to control adjustment of a foot section of the foundation. The buttons 906A and 906B can be configured to control adjustment of a head section of the foundation. The buttons 904A and 904B can also be located closer to the foot section of the foundation while the buttons 906A and 906B can be located closer to the head section of the foundation. The button 904A can be used to raise the foot section, the button 904B can lower the foot section, the button 906A can raise the head section, and the button 906B can lower the head section. The buttons 904A and 906A or 904B and 906B can be pressed simultaneously in order to raise the head and foot sections or lower the head and foot sections at the same time.

As described throughout, the interface 900 can include a plurality of switches that are connected to the buttons 904A, 904B, 906A, and 906B. The plurality of switches can be communicatively coupled to an articulation system. Therefore, when the user presses the button 904A, a corresponding switch is actuated, thereby sending a signal to the articulation system to raise the foot section of the foundation. Moreover, as described throughout, the interface 900 can include buttons 908A and 908B. The buttons 908A and 908B can be positioned outside of the recessed region 902, thereby making it relatively easy to locate and/or press such buttons. The buttons 908A and 908B can be configured to control one or more operations of the foundation (or peripheral devices), such as resetting the foundation to a flat position or adjusting the foundation to a favorite position.

Additionally, the user interface 900 can include a base 910 that is used to retain the interface 900 against a side of the foundation. The base 910 can be positioned between a bottom of a mattress and a top of the foundation. One or more fastener holes 912A-N (e.g., screw or bolt holes) can be used to receive fasteners to retain the base 910 to the foundation top.

FIGS. 10A-D depict another embodiment of a user interface 1000. The user interface 1000 can include buttons 1002A, 1002B, 1001, and 1003 (e.g., refer to FIG. 10A). The interface 1000 can be communicatively coupled to an articulation system as described herein. For example, communication can be via a wire 1004. Communication can also be wireless. The button 1002A can be configured to raise a head or foot section of a foundation. The button 1002B can be configured to lower a head or foot section of the foundation. The user can press the button 1001 in order to configure the buttons 1002A and 1002B to control the head section of the foundation. Likewise, the user can press the button 1003 to configure the buttons 1002A and 1002B to control the foot section of the foundation. Therefore, the user can switch between control of the head or foot section by pressing the buttons 1001 and 1003.

Figure 10A:
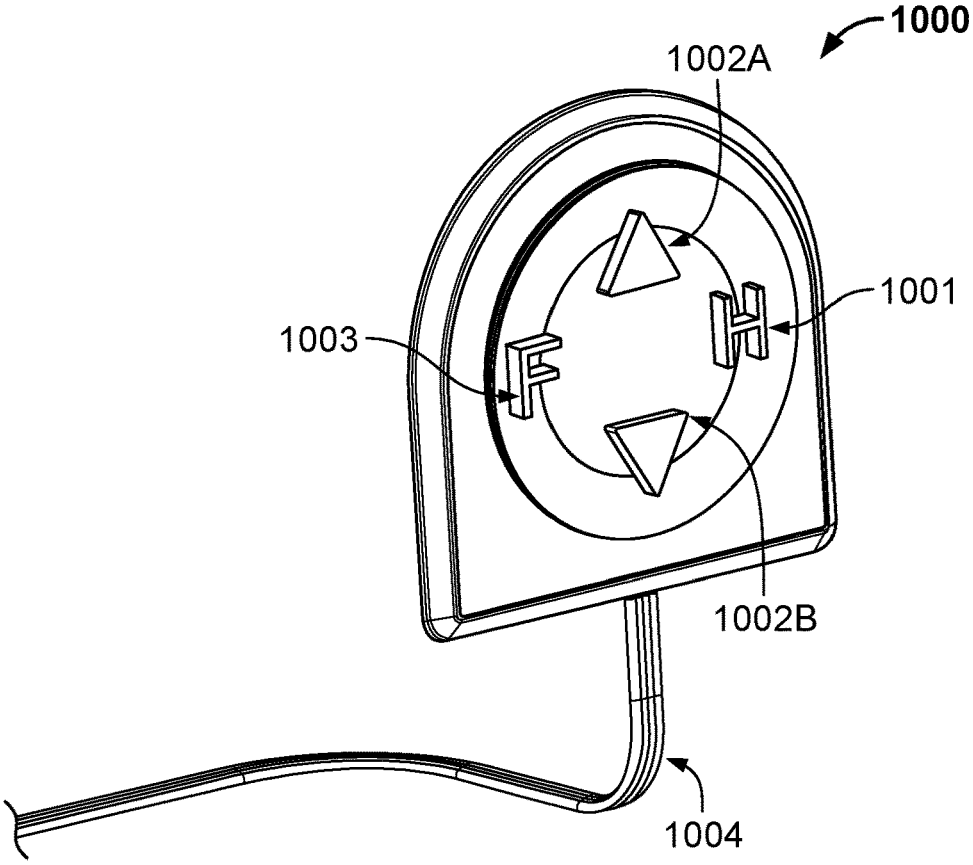
FIGS. 10A-D depict another embodiment of a user interface.
Figure 10B:
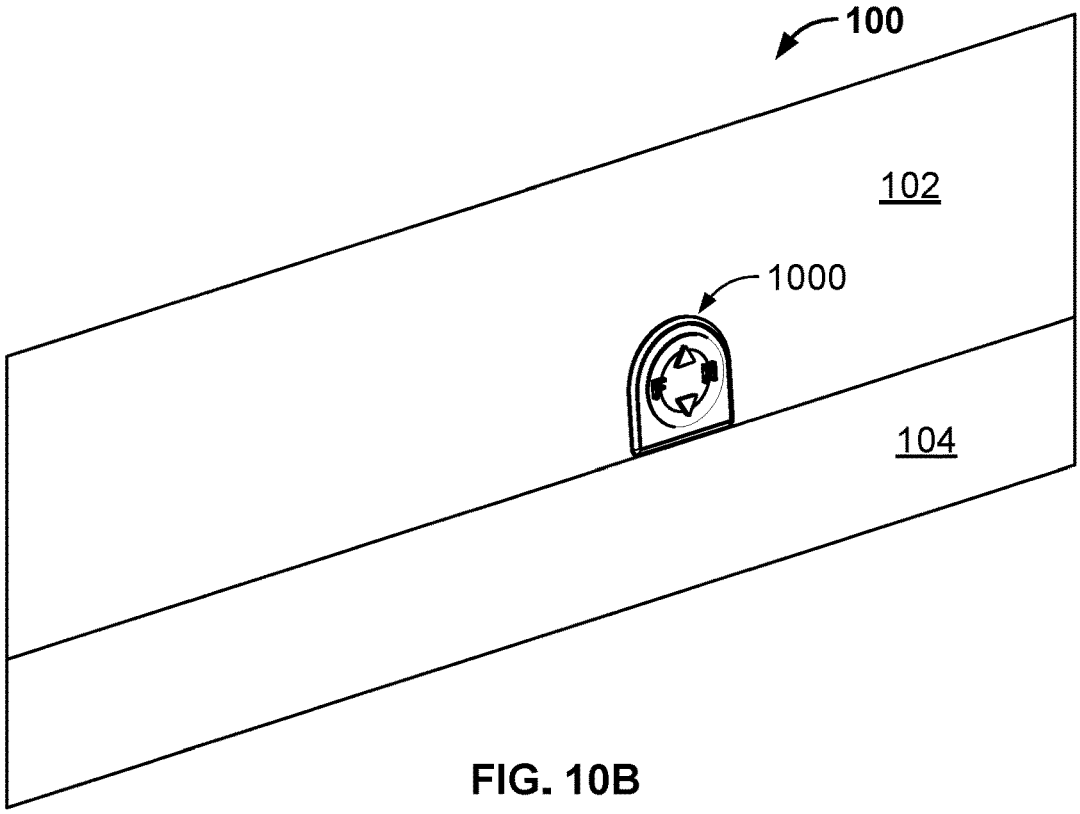
Figure 10C:
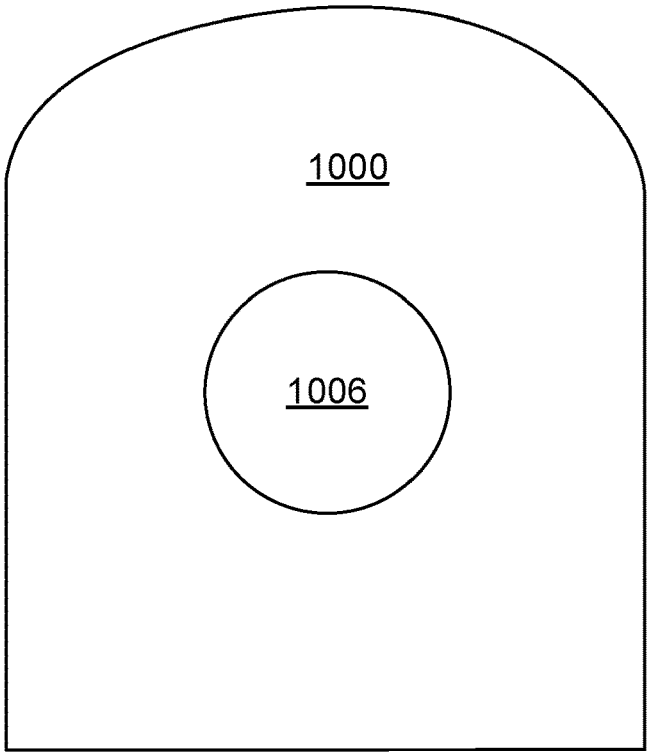

The user interface 1000 can include a magnet 1006 attached to a back surface of the interface 1000 (e.g., refer to FIG. 10C). Another ferrous metal can be used instead of the magnet 1006. The magnet 1006 can be used to configure or attach the user interface 1000 to the bed system 100. For example, as depicted in FIG. 10B, the user interface 1000 can be mounted to a side of the mattress 102 rather than a side of the foundation 104. The magnet 1006 can retain the interface 1000 flush against the side of the mattress 102 such that sheets can easily go over the interface 1000 and conceal it from view. Placing the sheets over the interface 1000 can also be advantageous to prevent the interface 1000 from being damaged, accidentally removed, or actuated. Moreover, the user can still feel and press the buttons 1002A, 1002B, 1001, and 1003 through the sheets in order to adjust the foundation 104.

Figure 10D:
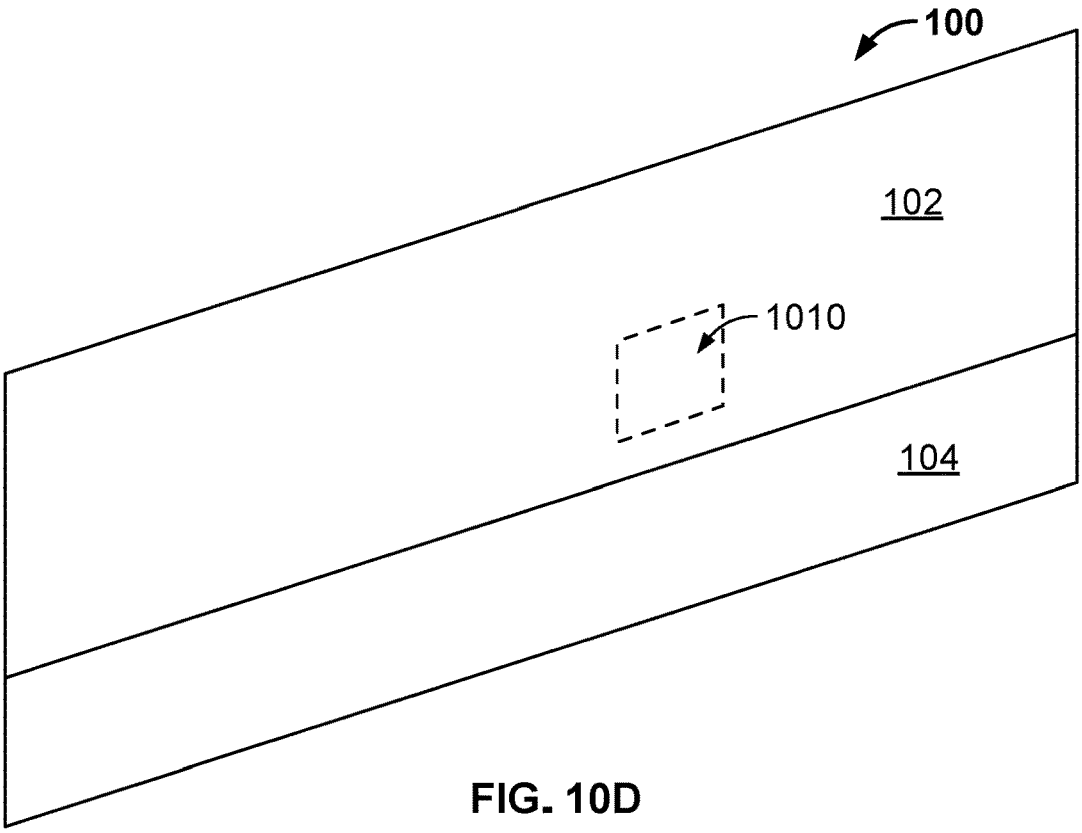

As depicted in FIG. 10D, a small piece of fabric 1010 can be sewn to an interior cover of the mattress 102. The fabric 1010 can be sewn to the interior of the cover along three sides, thereby creating an opening at a top of the fabric 1010 through which a magnet or other ferrous metal can be placed. The fabric 1010 can resemble a pocket. When the user interface 1000 is placed against the fabric 1010, the magnet 1006 can attach to the magnet placed between the fabric 1010 and the interior of the mattress cover (e.g., inside the pocket). The user interface 1000 can then be retained in place, flush against the side of the mattress 102 such that sheets can be placed over the interface 1000. In some examples, the user interface 1000 can also be placed inside a pocket created by the fabric 1010 when it is sewn into the interior of the mattress cover. Therefore, the user interface 1000 may not require attachment to a magnet or other ferrous material.

In some examples, the fabric 1010 can be longer (e.g., extending along some or nearly an entire length of a side of the mattress 102) and sewn along the interior cover of the mattress 102. A magnet or other ferrous metal can then be loosely positioned between the fabric 1010 and the interior cover of the mattress 102. The user can move the loose magnet to a desired position along the side of the mattress 102 to attach the user interface 1000 at different locations. Therefore, the user can position the user interface 1000 closer to the head portion of the foundation 104 if the user desires. In some embodiments, once the magnet 1006 of the user interface 1000 attaches to the magnet between the fabric 1010 and the interior cover of the mattress 102, the user can slide the interface 1000 along the length of the mattress 102 to adjust a location of the interface 1000.

FIGS. 11A-F depict an embodiment of a bed system 100 having a foundation 104, and user interfaces 106A and 106B for two sleepers. The foundation 104 can include two sections: a first foundation section 104A and a second foundation section 104B. Each of the foundation sections 104A-104B can support a section of a mattress or mattresses (not shown) on which one or more sleepers can rest. For example, a first sleeper can sleep on a mattress supported on the first foundation section 104A and a second sleeper can sleep on a mattress supported on the second foundation section 104B.

Each foundation section 104A-B can be independently articulable and controllable by functions of the user interfaces described herein. More particularly, each foundation section 104A-B can have a respective user interface 106A-B. Each foundation section 104A-B may also have a respective articulable head portion 1102A and 1102B as well as a respective articulable foot portion 1104A and 1104B. Each foundation section 104A-B can further include respective openings 1106A and 1106B. The openings 1106A-B can be used to move and/or route wires for any components described throughout this disclosure. The openings 1106A-B can also be configured to receive air hoses of an inflatable air mattress (for use in embodiments having such an inflatable air mattress) or other component of the bed system described throughout this disclosure.

The foundation sections 104A-B in FIGS. 11A-E can be configured to adjust in overall height (e.g., by raising or lowering legs of the foundation sections 104A-B) and inclination (e.g., by tilting the entire foundation section 104A-B) in addition to independent adjustment of either head portions 1102A-B and/or foot portions 1104A-B. Such adjustments can be made using the user interfaces 106A-B described throughout this disclosure. Adjusting the overall height of either foundation section 104A or 104B can beneficially provide for easy bed entry and exit. For users needing extra support, head and/or foot adjustments of the user interface 106A can be used to lower or raise the entire foundation sections 104A and/or 104B, thereby providing easier entry and exit for the user(s).

Figure 11A:
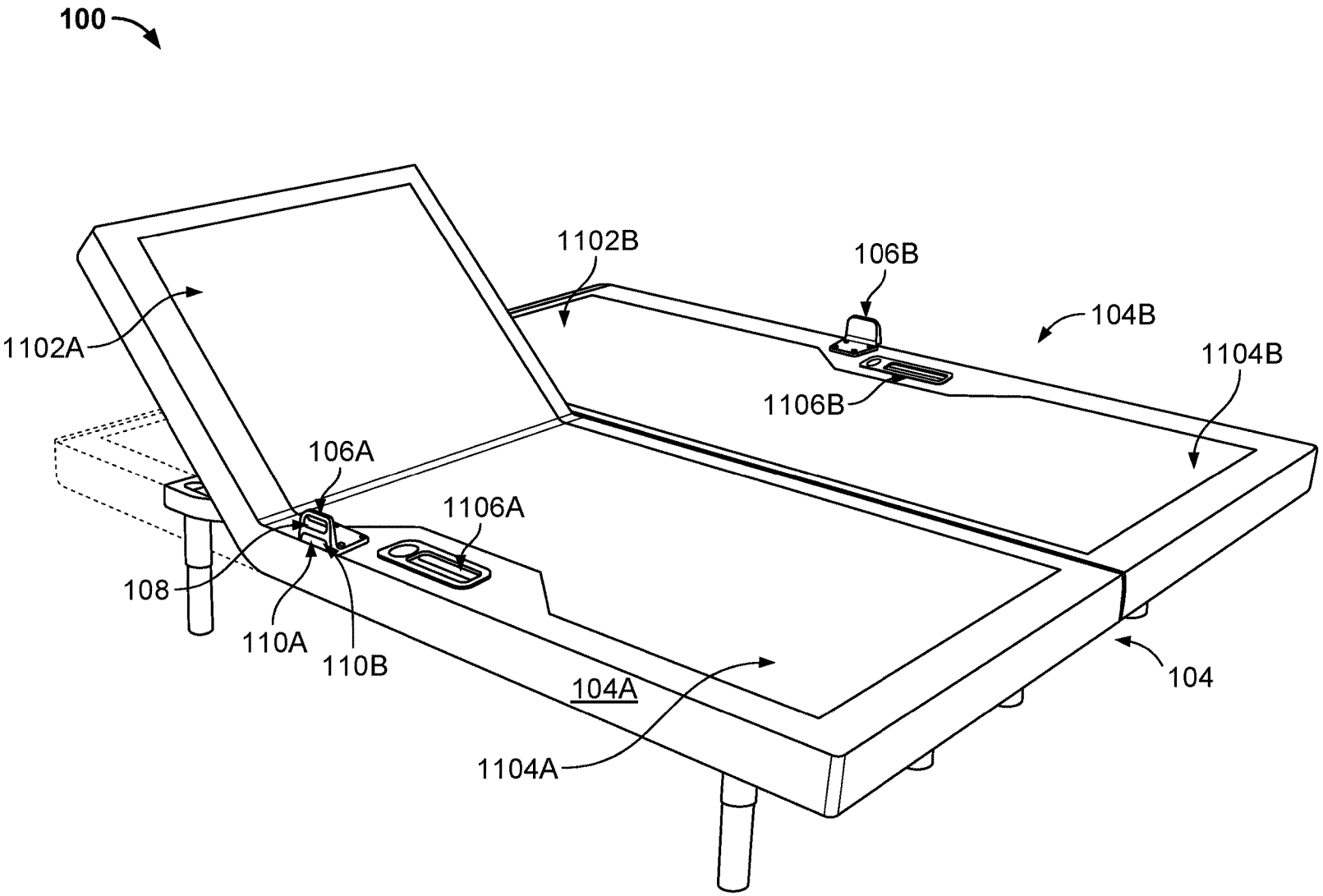
FIGS. 11A-F depict an embodiment of a bed system having a foundation, a mattress, and user interfaces for two sleepers.

For example, as shown in FIG. 11A, a user of the bed system 100 can select a button on the user interface 106A to raise an overall height of the foundation section 104A. As a result, an articulation system (e.g., articulation system 112 in FIG. 1A) of the bed system 100 as described throughout this disclosure, can be activated to extend the legs of the foundation section 104A to raise the height of the foundation section 104A to the customer-desired height. The foundation section 104A therefore appears taller than the foundation section 104B in FIG. 11A (e.g., the legs of the foundation section 104A have been automatically extended to a desired height while the foundation section 104B remains at a current height). The user can select another button, or the same button, on the user interface 106A to further raise/articulate the head portion 1102A of the foundation section 104A. As shown in FIG. 11A, the foundation section 104B is in a flat position relative to a horizontal plane, with neither head nor foot portions 1102B, 1104B being articulated.

Each of the foundation sections 104A-B can be individually raised and/or tilted using the respective controls on the user interfaces 106A-B. For example, the user of the foundation section 104A can use the adjustment bar 108 on the user interface 106A to raise or lower the entire foundation section 104A to a desired height. The user can also tilt the entire foundation section 104A using the adjustment bar 108. Raising or lifting up on the adjustment bar 108 can cause the articulation system of the bed system to increase a height of the foundation section 104A by causing the legs that support the foundation section 104A to extend until the desired height is reached. The user may also raise a portion or side of the adjustment bar 108 that corresponds to the head portion 1102A and/or the food portion 1104A to raise the respective portion of the foundation section 104A. Therefore, the same controls on the user interface 106A can be used to adjust the entire foundation section 104A as well as the individual head portion 1102A and/or foot portion 1104A of the foundation section 104A.

In some implementations, one of the buttons 110A-B can be selected by the user to change what controls are associated with movement of the adjustment bar 108, or to switch between different control modes for the adjustment bar 108. For example, the user can select the button 110A to toggle between using the adjustment bar 108 to control the entire foundation section 104A (e.g., full raise or lower and full tilt) and using the adjustment bar 108 to control the head portion 1102A and the foot portion 1104A (e.g., incline and decline). As an illustrative example, the user can click the button 110A once to cause the adjustment bar 108 to be put into a mode in which the adjustment bar 108 is used to adjust the entire foundation section 104A. The user can click the button 110A a second time to cause the adjustment bar 108 to be put into another mode in which the adjustment bar 108 is used to selectively control adjusting the head portion 1102A and the foot portion 1104A of the foundation section 104A. As a result, the same adjustment bar 108 can be used to control adjustment of both the entire foundation section 104A as well as the head and foot portions 1102A and 1104A.

In some implementations, the user can double click one of the buttons 110A-B to flip or switch between different control modes of the adjustment bar 108 and/or the buttons 110A-B. For example, double clicking the button 110A can cause the controls of the user interface 106A (such as the adjustment bar 108) to be used for controlling adjustment of the head portion 1102A of the foundation section 104A. The user can double click the button 110A again to cause the controls to be used for another mode, such as a mode in which the entire foundation section 104A can be raised and/or tilted to a desired height and angle (using the adjustment bar 108). In this mode, the foundation section 104A can be tilted from the head portion 1102A to the foot portion 1104A with the head portion 1102A being higher than the foot portion 1104A and with the foundation section 104A being substantially straight between the head portion 1102A and the foot portion 1104A.

As an illustrative example, the user can raise the entire adjustment bar 108 to cause the entire foundation section 104A to be raised or lowered to a desired height. The user can then raise or lower a portion of the adjustment bar 108 to tilt the entire foundation section 104A to a desired angle. For example, by raising a portion of the adjustment bar 108 closest to the head portion 1102A, the entire foundation section 104A can be tilted such that the head portion 1102A is elevated and declining to the foot portion 1104A (e.g., a position for snore mitigation). Sleeping with the head portion 1102A elevated can open the user's airway for easy breathing and increased blood flow for improved circulation. An increase in blood oxygen can also reduce stress on the user's heart while maintaining proper spinal alignment. Moreover, adjusting the foundation section 104A such that the head portion 1102A is elevated can mitigate sleep apnea and acid reflux while maintaining comfortability of the user while they are asleep.

As another example, by raising a portion of the adjustment bar 108 closest to the foot portion 1104A, the entire foundation section 104A can be tilted such that the foot portion 1104A is elevated and declining towards the head portion 1102A. Sometimes, the user may also click or double click on the button another time to go back to the head adjustment mode and/or another adjustment mode.

In some implementations, one of the buttons 110A-B can be used to adjust the entire foundation section 104A to a favorite or preferred height and/or tilt. For example, the button 110B can be a favorite button. The user can set their favorite position (e.g., height and/or tilt) as a preset, such that when the button 110B is selected, the foundation section 104A can be automatically adjusted to the user's preferred position. The user may also click on the button 110B to cause the entire foundation section 104A to be lowered to a lowest height, raised to a highest height, tilted to a desired position in which the head portion 1102A is higher than the foot portion 1104A, tilted to a desired position in which the head portion 1102A is lower than the foot portion 1104A, or adjusted to any other preset position.

Figure 11B:
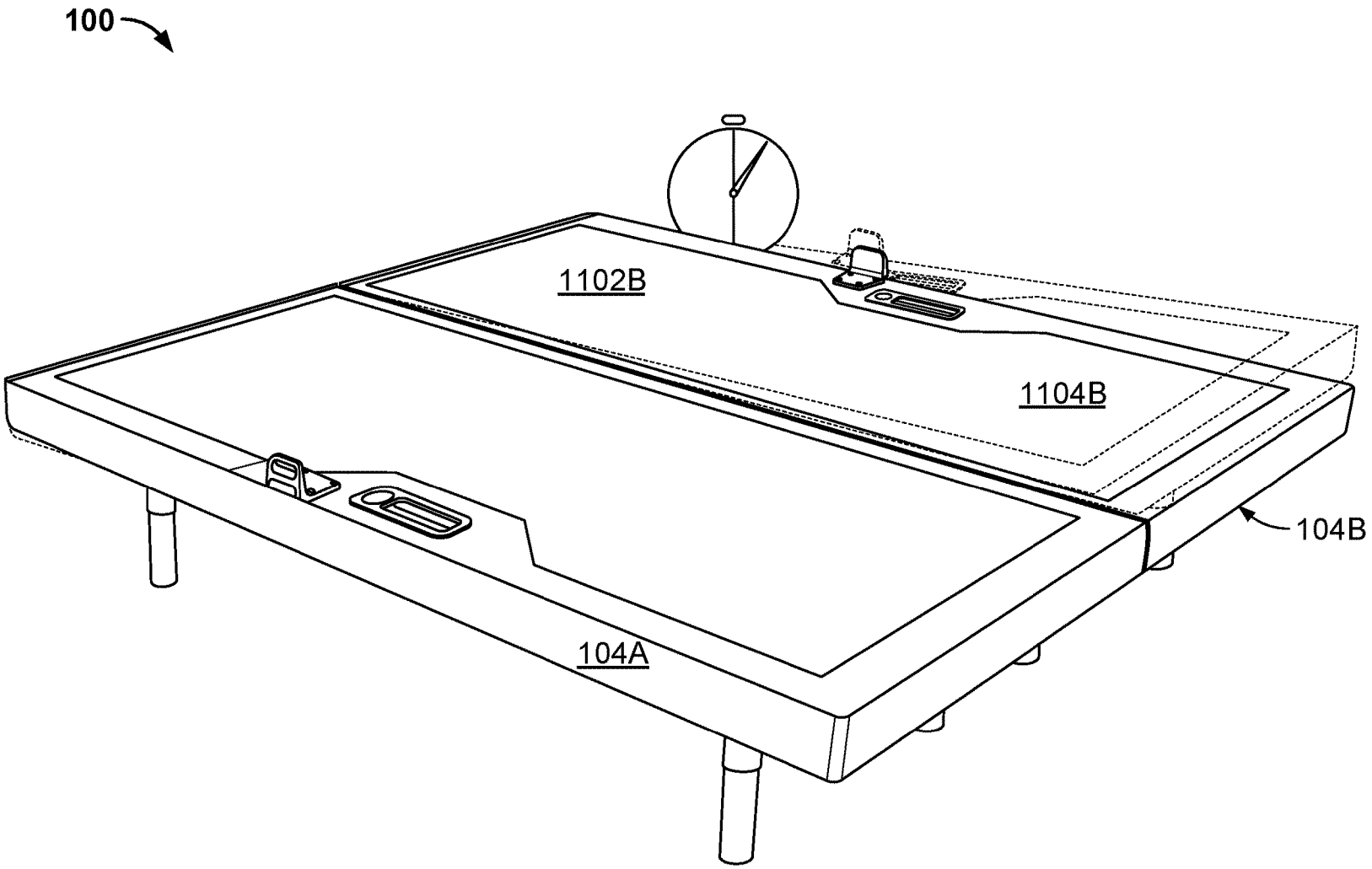

FIG. 11B shows a rotation motion of the second foundation section 104B from a flat position to be a fully tilted position. The full tilt of the foundation section 104B can be beneficial to improve breathing of the user. The full tilt can also be beneficial to increase blood flow to improve the user's circulation in any sleeping position. Here, the foundation section 104B is fully tilted from the head portion 1102B to the foot portion 1104B with the head portion 1102B being lower than the foot portion 1104B and with the fully tilted foundation section 104B being substantially straight between the head portion 1102B and the foot portion 1104B.

Figure 11C:
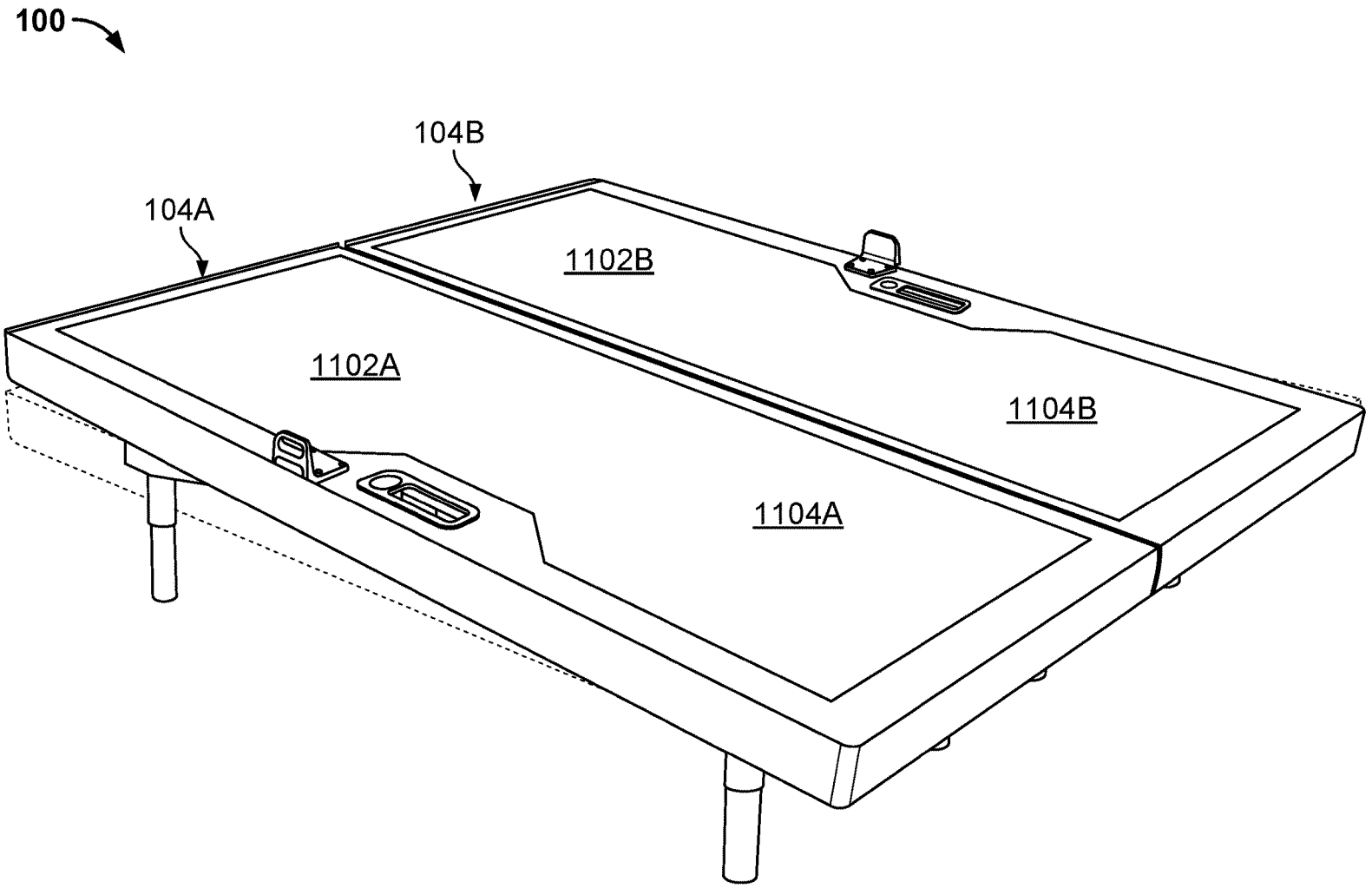

FIG. 11C depicts the foundation sections 104A-B in a position, in which head portions 1102A and 1102B of the respective foundation sections 104A-B are elevated above foot portions 1104A and 1104B of the respective foundation sections 104A-B and with the foundation sections 104A-B being substantially straight between the head portions 1102A and 1102B and the foot portions 1104A and 1104B. As described herein, each of the sections 104A-B can be separately articulable using their respective user interfaces 106A-B (refer to FIG. 11A). Moreover, as shown in FIG. 11C, the sections 104A-N can also be articulated and adjusted simultaneously to achieve a similar or same height and/or tilt. A single mattress, such as a twin, full, queen, or king mattress, can be laid on top of the sections 104A-N when the entire sections 104A-N are tilted. As a result, the entire mattress is tilted. Separately articulating the sections 104A-N can work with a split mattress, such as a split king, a split top king, and an H-bed king, and/or twin XL mattresses that are placed next to each other to form a king size bed.

Figure 11D:
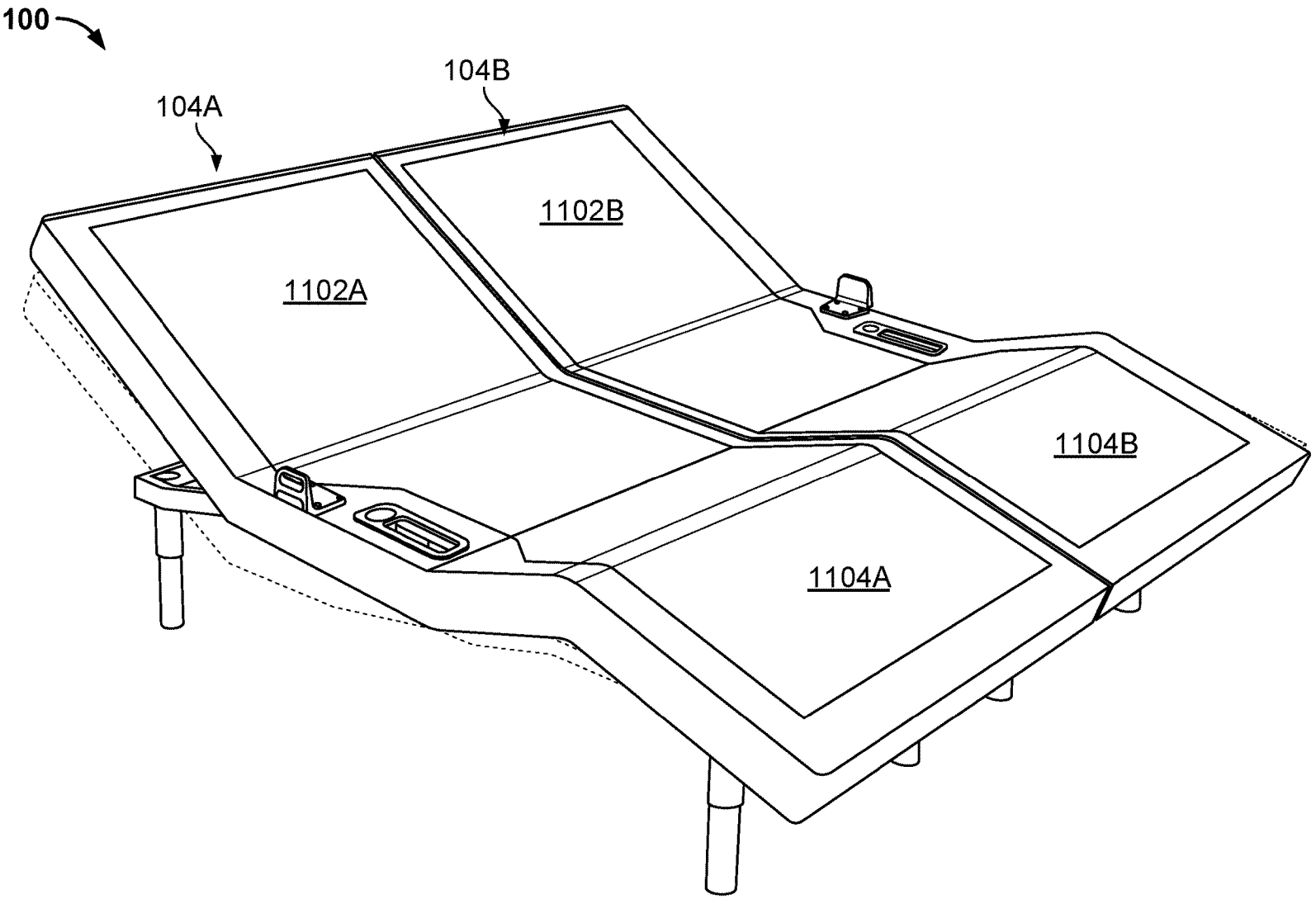

FIG. 11D depicts the foundation sections 104A and 104B in first and second positions. In the first position, the head portions 1102A and 1102B and the foot portions 1104A and 1104B have been independently articulated. The head portions 1102A and 1102B are raised into a position that allows the users to sit up in bed. The foot portions 1104A and 1104B have also been raised into a position that elevates feet of the users, which can improve circulation and blood flow. In the second position, the head portions 1102A and 1102B and the foot portions 1104A and 1104B remain tilted/raised similarly as they were in the first position, except that the entire structure of the bed system 100 is rotated such that the head portions 1102A and 1102B of the foundation sections 104A and 104B are raised higher and the foot portions 1104A and 1104B of the foundation sections 104A and 104B remain substantially the same height as in the first position. Moreover, as described herein, users of the bed system may independently control articulation of their respective foundation sections 104A and 104B, head sections 1102A and 1102B, and foot sections 1104A and 1104B using the user interfaces 106A and 106B. As a result, each user can customize their respective sides of the bed system for optimal quality of sleep, breathing, blood flow, and circulation.

Figure 11E:
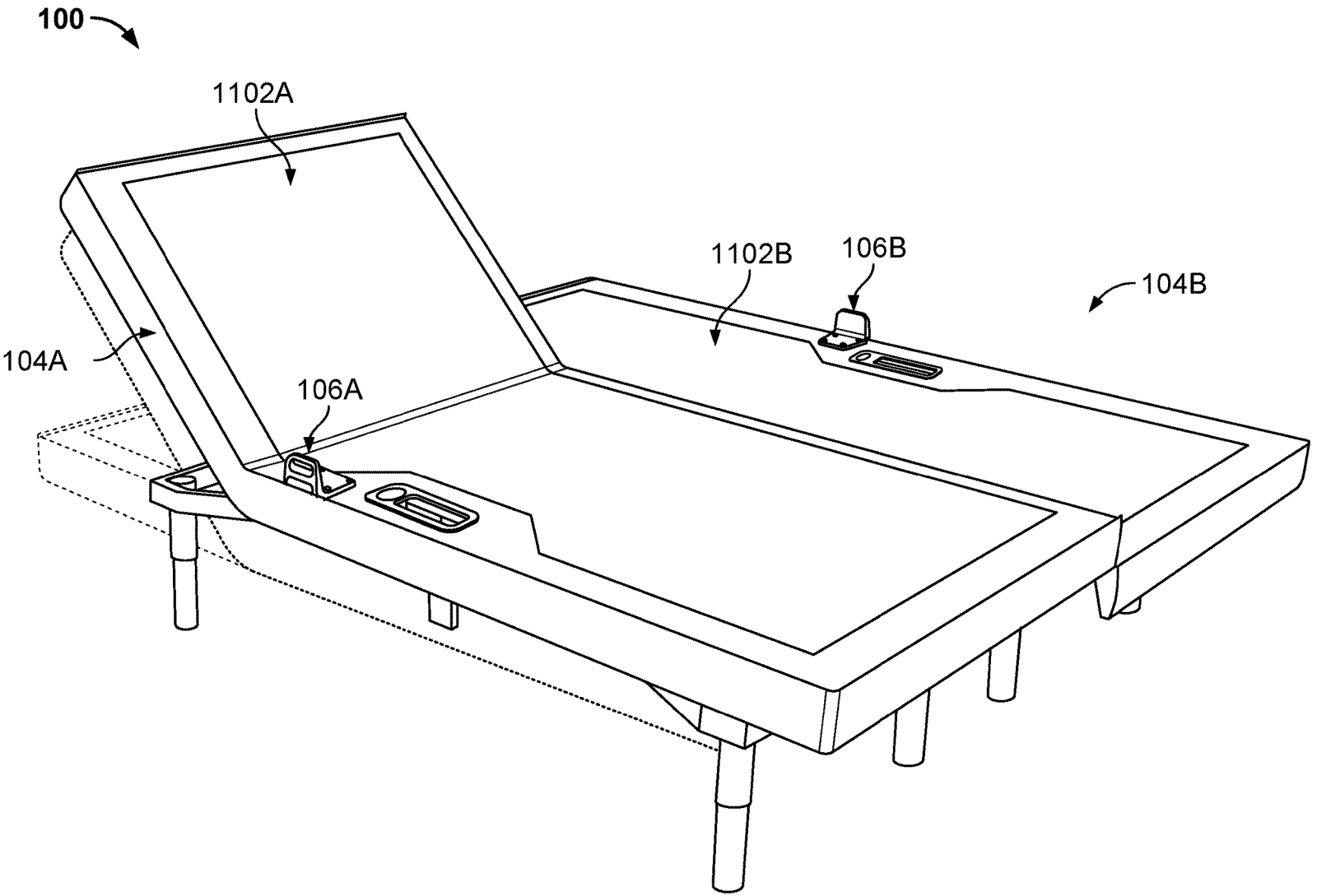

FIG. 11E depicts independent articulation of the foundation sections 104A and 104B. Here, the foundation section 104A is elevated to a raised position 104A. The foundation section 104B, on the other hand, may be lowered to a height that is preferred for the user to enter and exit the bed system 100. Moreover, the head portion 1102A of the foundation section 104A has been raised to a desired incline while the head portion 1102B of the foundation section 104B remains in a flat position.

Figure 11F:
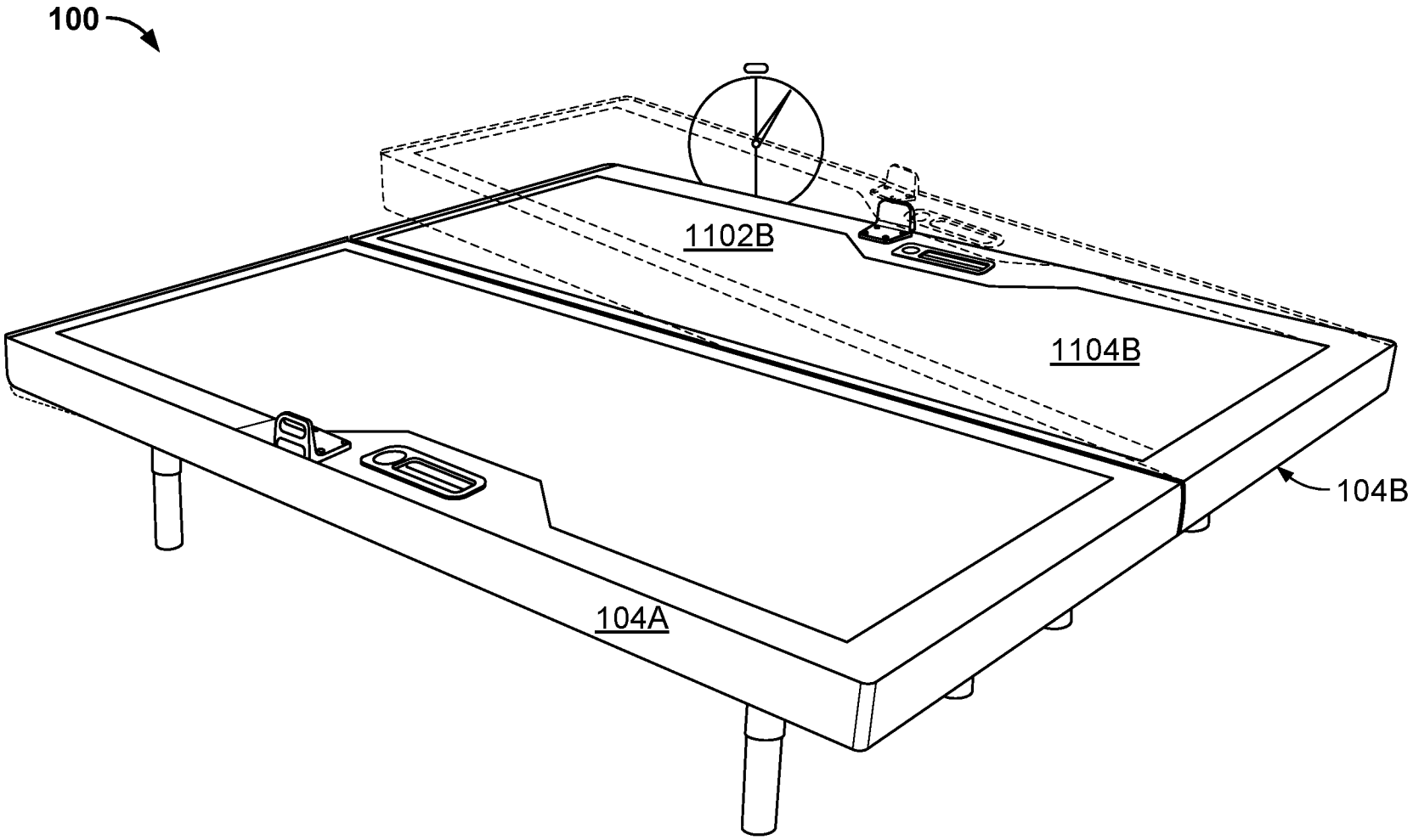

FIG. 11F shows a rotation motion of the second foundation section 104B from a flat position to be a fully tilted position. The full tilt of the foundation section 104B can be beneficial to improve breathing of the user and/or reduce or prevent snore. Here, the foundation section 104B is fully tilted from the head portion 1102B to the foot portion 1104B with the head portion 1102B being higher than the foot portion 1104B and with the fully tilted foundation section 104B being substantially straight (e.g., flat) between the head portion 1102B and the foot portion 1104B.

Although FIGS. 11A-F are described in reference to a bed system 100 that includes the first and second foundation sections 104A and 104B, the disclosure of FIGS. 11A-F can also apply to bed systems having one foundation section, such as the first foundation section 104A. Therefore, the disclosure of FIGS. 11A-F can apply to a bed system for one sleeper. The sleeper can therefore adjust the entire adjustable foundation 104A to raise or lower in height and/or tilt to a desired position. The sleeper can also articulate a head portion 1102A and/or foot portion 1104A of the adjustable foundation 104A using the techniques described herein.

A number of embodiments of the invention have been described. Nevertheless, it will be understood that various modifications may be made without departing from the spirit and scope of the invention. For example, the shape, size, and location of various components of the mattress, foundation, and user interface can be modified as suitable for the application. Similarly, one or more features present on one or more of the various embodiments can be considered optional, and need not necessarily be included in all embodiments. Additionally, features of one embodiment can be combined with or replace features of another embodiment, such as replacing the buttons 1002A, 1002B, 1001, and 1003 of the user interface 1000 (see FIG. 10A) with the adjustment bar 108 or an adjustment bar of another embodiment. Accordingly, other embodiments are within the scope of the following claims.

What is claimed is:

1. A bed system comprising:
an adjustable foundation comprising:
a head section;
a foot section;
an actuation system connected to the head section and the foot section; and
a user interface having at least one adjustment bar, wherein the user interface is communicatively coupled to the actuation system such that raising a foot portion of the at least one adjustment bar signals the actuation system to raise the foot section of the adjustable foundation, raising a head portion of the at least one adjustment bar signals the actuation system to raise the head section of the adjustable foundation, lowering the foot portion of the at least one adjustment bar signals the actuation system to lower the foot section of the adjustable foundation, and lowering the head portion of the at least one adjustment bar signals the actuation system to lower the head section of the adjustable foundation, wherein the user interface is rigidly mounted to a side of the adjustable foundation.

2. The bed system of claim 1, wherein the at least one adjustment bar is a single rigid bar including both the head portion and the foot portion.

3. The bed system of claim 1, wherein the at least one adjustable bar includes first and second bars, each of the first and second bars defining respective central ends and respective outer ends, the first and second bars hingedly connected at the central ends, wherein raising the first bar signals the actuation system to raise the foot section of the adjustable foundation, raising the second bar signals the actuation system to raise the head section of the adjustable foundation, lowering the first bar signals the actuation system to lower the foot section of the adjustable foundation, and lowering the second bar signals the actuation system to lower the head section of the adjustable foundation.

4. The bed system of claim 1, wherein raising all portions of the at least one adjustment bar signals the actuation system to raise the foot section and the head section of the adjustable foundation at a same time and to a same height, and lowering all portions of the at least one adjustment bar signals the actuation system to lower the foot section and the head section of the adjustable foundation at the same time and to the same height.

5. The bed system of claim 1, wherein the user interface further comprises at least one button, wherein pressing the at least one button signals the actuation system to move at least one of the head section and the foot section of the adjustable foundation to a predetermined position, wherein the predetermined position is at least one of a flat position and a favorite position.

6. The bed system of claim 5, wherein the at least one button is connected to at least one switch, wherein pressing the at least one button further comprises actuating the at least one switch, which signals the actuation system to move at least one of the head section and the foot section of the adjustable foundation to the predetermined position.

7. The bed system of claim 5, wherein the at least one button includes a first button and a second button such that pressing the first button signals the actuation system to move the adjustable foundation to a flat position and pressing the second button signals the actuation system to move the adjustable foundation to a favorite position.

8. The bed system of claim 5, wherein double clicking the at least one button causes the at least one adjustment bar to switch between a first mode for selectively adjusting the head section and the foot section of the adjustable foundation and a second mode for adjusting the head section and the foot section of the adjustable foundation at a same time.

9. The bed system of claim 1, wherein raising the head portion of the at least one adjustment bar signals the actuation system to tilt the adjustable foundation to a predetermined angle.

10. The bed system of claim 1, wherein the actuation system includes a controller and one or more actuators configured to raise and lower the head and foot sections of the adjustable foundation.

11. The bed system of claim 1, wherein the user interface is sized based at least in part on a thickness of at least one of the adjustable foundation or a mattress positioned on the adjustable foundation.

12. The bed system of claim 1, wherein the foot portion of the at least one adjustment bar is positioned at an angle different than an angle of the head portion of the at least one adjustment bar such that the at least one adjustment bar is tilted in at least one of a downward or an upward position.

13. The bed system of claim 5, wherein:

the at least one adjustment bar is positioned in a recessed region of the user interface, and the at least one button is positioned beneath the at least one adjustment bar and in the recessed region of the user interface.

14. The bed system of claim 1, wherein the user interface further comprises a base configured to be positioned between a top of the adjustable foundation and a bottom of a mattress positioned on the adjustable foundation such that the user interface is flush with a side of the adjustable foundation and extends up along a side of the mattress.

15. The bed system of claim 14, wherein the base of the user interface is configured to attach to the top of the adjustable foundation using one or more fasteners.

16. The bed system of claim 14, wherein the mattress flattens down over the base of the user interface.

17. The bed system of claim 5, wherein pressing the at least one button signals the actuation system to raise the foot section and the head section of the adjustable foundation to a predetermined height at a same time.

18. A bed system comprising:

an adjustable foundation comprising:

a head section;

a foot section;

an actuation system connected to the head section and the foot section; and a user interface communicatively coupled to the actuation system, the user interface comprising:

at least one adjustment bar; and at least one button, wherein actuation of the at least one button switches between a first bar mode and a second bar mode, wherein in the first bar mode, actuation of a head end of the adjustment bar selectively raises or lowers the head section and actuation of a foot end of the adjustment bar selectively raises or lowers the foot section, and wherein in the second bar mode, actuation of the head end of the adjustment bar tilts the head section and the foot section at substantially the same angle and actuation of the foot end of the adjustment bar tilts the head section and the foot section at substantially the same angle, wherein the foot section and the head section are configured to remain in the same plane during tilting in the second bar mode.

19. The bed system of claim 1, wherein the at least one adjustment bar is mounted to the adjustable foundation and movable thereon.

20. A bed system comprising:

an adjustable foundation comprising:

a head section;

a foot section;

an actuation system connected to the head section and the foot section; and a user interface having at least one adjustment bar, wherein the user interface is communicatively coupled to the actuation system such that raising a foot portion of the at least one adjustment bar signals the actuation system to raise the foot section of the adjustable foundation, raising a head portion of the at least one adjustment bar signals the actuation system to raise the head section of the adjustable foundation, lowering the foot portion of the at least one adjustment bar signals the actuation system to lower the foot section of the adjustable foundation, and lowering the head portion of the at least one adjustment bar signals the actuation system to lower the head section of the adjustable foundation, wherein the at least one adjustment bar defines a top surface and a bottom surface, wherein the head portion of the at least one adjustment bar is configured to be raised by a user pulling on the bottom surface of the at least one adjustment bar at the head portion of the at least one adjustment bar, and wherein the foot portion of the at least one adjustment bar is configured to be raised by the user pulling on the bottom surface of the at least one adjustment bar at the foot portion of the at least one adjustment bar.

21. The bed system of claim 1, wherein the adjustment bar is movably mounted to the user interface such that the head and foot portions of the adjustment bar can be raised and lowered with respect to the user interface.

22. The bed system of claim 18, wherein the foot section and the head section are configured to rotate together in the same angular direction during tilting in the second bar mode.

23. The bed system of claim 18, wherein the foot section and the head section are configured to remain parallel during tilting in the second bar mode.

* * * * *